US005971146A

United States Patent [19]

Jones

[11] Patent Number: 5,971,146

[45] Date of Patent: Oct. 26, 1999

[54] LOCKING GOLF BAG

[76] Inventor: Clifford D. Jones, 9424 Tulley Ave, Oak Lawn, Ill. 60453-2441

[21] Appl. No.: 08/882,847

[22] Filed: Jun. 26, 1997

[51] Int. Cl.[6] ..... A63B 55/00; A63B 57/00

[52] U.S. Cl. ..... 206/315.3; 206/315.6

[58] Field of Search ..... 206/315.2–315.8; 70/58

[56] References Cited

U.S. PATENT DOCUMENTS

| | | | |
|---|---|---|---|
| 1,717,959 | 6/1929 | Cauffman | 206/315.6 |
| 1,770,060 | 7/1930 | Barlow | 206/315.6 |
| 4,538,728 | 9/1985 | Lewis | 206/315.3 |
| 4,860,889 | 8/1989 | Lemieux et al. | 206/315.6 |
| 4,863,019 | 9/1989 | Lewis et al. | 206/315.3 |
| 5,004,100 | 4/1991 | Smith | 206/315.3 X |
| 5,060,796 | 10/1991 | Brooks, III | 206/315.6 |
| 5,267,669 | 12/1993 | Kwon | 206/315.6 X |
| 5,511,660 | 4/1996 | Yamada et al. | 206/315.6 |
| 5,524,753 | 6/1996 | Murphy | 206/315.6 |
| 5,560,485 | 10/1996 | O'Hara, Jr. | 206/315.6 |
| 5,636,735 | 6/1997 | Stusek | 206/315.6 |

FOREIGN PATENT DOCUMENTS

| | | | |
|---|---|---|---|
| 2646785 | 11/1990 | France | 206/315.6 |

*Primary Examiner*—Sue A. Weaver
*Attorney, Agent, or Firm*—Kathleen Anne Ryan

[57] ABSTRACT

A locking golf bag has a body portion that includes a tubular wall having an inner surface, an outer surface and an upper edge. A divider plate that has a first opening and a second opening is secured to the tubular wall along the inner surface thereof. The bag also includes a closing member that is coupled to the divider plate and moveable between an open configuration and a closed configuration. The closing member has an outer edge, a first aperture, and a second aperture. When the closing member is in the open configuration, the first aperture is aligned with the first opening such that the first opening has an open size and the second aperture is aligned with the second opening such that the second opening has a first effective size. When the closing member is in the closed configuration, the first aperture is aligned with the first opening such that the first opening has a closed size and the second aperture is aligned with the second opening such that the second opening has a second effective size. The closed size of the first opening is within a range of from about 35 percent to about 45 percent of the open size of the first opening, and the second effective size of the second opening is within a range of from about 35 percent to about 45 percent of the first effective size of the second opening.

27 Claims, 9 Drawing Sheets

LOCKING GOLF BAG

FIELD OF THE INVENTION

This invention relates generally to devices that help to protect golf clubs which are positioned within a golf bag and in particular to devices that help to prevent theft of the golf clubs from the golf bag.

BACKGROUND OF THE INVENTION

As the game of golf has become increasingly popular, the price of golf equipment has soared. There is an extensive variety of golf clubs which are designed to satisfy the desires and skills of golf enthusiasts who range from duffers to pros. Although modern golf clubs show an amazing variety, they tend to have one thing in common, a high price. It is not uncommon to pay in excess of three-hundred dollars for a single golf club. Thus a full set of fourteen golf clubs can represent an investment of over four-thousand dollars! Not surprisingly, there is an increasing desire among golfers to protect their substantial investment in golf clubs. Unfortunately, the dynamics of modern golf are replete with opportunities in which a golfer's sizeable investment in his golf clubs can be damaged. For example, there is a growing trend of theft of golf clubs from unattended golf bags. Faced with an unattended golf bag, it is an easy and almost untraceable matter for a thief to remove a club and simply walk away. More daring thieves may even be tempted to take the entire golf bag. Excessive wear of golf clubs can also damage a golfer's investment in his golf equipment. Modern high caliber golf clubs are frequently constructed from high performance materials, such as graphite composites. Although these high performance materials provide many desirable characteristics, these material are often relatively soft and can therefore become marred easily. Thus, for example, the mere act of transporting a golf bag containing such high caliber golf clubs can nick or otherwise mar the clubs and thus damage the golfer's investment in the clubs.

SUMMARY OF THE INVENTION

It is therefore an object of this invention to provide a golf bag which can protect against theft of golf clubs from the bag.

Another object of this invention is to provide a golf bag that helps to protect against theft of the bag itself.

It is a further object of this invention to provide a golf bag that helps to protect against excessive wear of clubs which are transported within the bag.

These and other objectives and advantages are provided by the present invention which is directed to a locking golf bag that both locks golf clubs within the bag and supports clubs positioned in the bag. The locking golf bag has a body portion that includes a tubular wall having an inner surface, an outer surface and an upper edge. The body portion of the bag also has a closed bottom that is secured to the tubular wall opposite the upper edge. A divider plate that has a first opening and a second opening is secured to the tubular wall along the inner surface thereof. The first opening has a pre-determined size and is positioned at a first pre-determined distance from the inner surface of the tubular wall. The second opening has a pre-determined size and is positioned at a second pre-determined distance from the inner surface of the tubular wall. The second pre-determined distance is greater than the first pre-determined distance. The bag also includes a closing member that is coupled to the divider plate and moveable between an open configuration and a closed configuration. The closing member has an outer edge, a first aperture, and a second aperture. The first aperture has a pre-determined size and is located at a pre-determined position which is at a first pre-determined distance from the outer edge of the closing member. The second aperture has a pre-determined size and is positioned at a pre-determined location which is at a second pre-determined distance from the outer edge of the closing member. When the closing member is in the open configuration, the first aperture is aligned with the first opening such that the first opening has an open size and the second aperture is aligned with the second opening such that the second opening has a first effective size. When the closing member is in the closed configuration, the first aperture is aligned with the first opening such that the first opening has a closed size and the second aperture is aligned with the second opening such that the second opening has a second effective size. The closed size of the first opening is within a range of from about 35 percent to about 45 percent of the open size of the first opening, and the second effective size of the second opening is within a range of from about 35 percent to about 45 percent of the first effective size of the second opening.

The following list includes terms and definitions as used herein and in the appended claims:

1. the pre-determined size of the first opening is defined as the length of a size line that spans the first opening and is generally aligned with a direction of movement of the closing member.
2. the pre-determined distance of the first opening from the inner surface of the tubular wall is defined as the length of a position line that extends from the inner surface of the tubular wall to a first reference line that spans the first opening and is substantially parallel with a second reference line which intersects an outer edge of the divider plate without crossing the outer edge;
3. the pre-determined size of the second opening is defined as the length of a size line that spans the second opening and is generally aligned with a direction of movement of the closing member;
4. the predetermined distance of the second opening from the inner surface of the tubular wall is defined as the length of a position line that extends from the inner surface of the tubular wall to a first reference line that spans the second opening and is substantially parallel with a second reference line which intersects the outer edge of the divider plate without crossing the outer edge;
5. the pre-determined size of the first aperture is defined as the length of a size line that spans the first aperture and is generally aligned with a direction of movement of the closing member;
6. the pre-determined distance of the first aperture from the outer edge of the closing member is defined as the length of a position line that extends from the outer edge of the closing member to a first reference line that spans the first aperture and is substantially parallel with a second reference line which intersects the outer edge of the closing member without crossing the outer edge of the closing member;
7. the pre-determined size of the second aperture is defined as the length of a size line that spans the second aperture and is generally aligned with a direction of movement of the closing member;
8. the predetermined distance of the second aperture from the outer edge of the closing member is defined as the length of a position line that extends from the outer edge of the closing member to a first reference line that spans the second aperture and is substantially parallel with a second reference line which intersects the outer edge of the closing member without crossing the outer edge of the closing member;

9. the open size of the first opening is defined as the length of an open size line that spans an exposed portion of the first aperture and is generally aligned with a direction of movement of the closing member when the closing member is in the open configuration;

10. the first effective size of the second opening is defined as the length of a first effective size line that spans an exposed portion of the second aperture and is generally aligned with a direction of movement of the closing member when the closing member is in the open configuration;

11. the closed size of the first opening is defined as the length of an closed size line that spans an exposed portion of the first aperture and is generally aligned with a direction of movement of the closing member when the closing member is in the closed configuration; and 12. the second effective size of the second opening is defined as the length of a second effective size line that spans an exposed portion of the second aperture and is generally aligned with a direction of movement of the closing member when the closing member is in the closed configuration.

When the closing member is in the open configuration, the open size of the first opening in the divider plate and the first effective size of the second opening in the divider plate are such that golf clubs may be placed within or removed from the locking golf bag in the conventional manner where the handle portions are positioned within the bag and the club head portions of the clubs extend from the bag. When the closing member is in the closed configuration, the closed size of the first opening and the second effective size of the second opening are such that handle portions of conventional golf clubs cannot fit through the exposed portions and of the first and second apertures. Consequently, when the closing member is in the closed configuration, golf clubs cannot be removed from the locking golf bag. The locking golf bag can also include a locking member that locks the closing member in the closed configuration. The closing member can thus operate in conjunction with the divider plate to help to prevent theft of golf clubs from the locking golf bag.

The closing member can include a slider plate that is slidingly moveable in a pre-determined slider direction from a first position to a second position. A terminating edge of the slider plate defines the outer edge of the closing member. The first aperture being formed in the slider plate at the pre-determined position of the first aperture and the second aperture being formed in the slider plate at the pre-determined location of the second aperture. When the sliding plate is in the first position, the closing member is in the open configuration and golf clubs can be positioned within or removed from the locking golf bag in the conventional manner. When the slider plate is in the second position, the closing member is in the closed configuration and so golf clubs cannot be removed from the locking golf bag.

In an alternative embodiment, the closing member includes a first rotating plate, a second rotating plate, and coupling means for coupling the first rotating plate to the second rotating plate. The first rotating plate is rotatably moveable between a first position and a second position. The first rotating plate has a terminating edge that defines the outer edge of the closing member and an inner edge that defines a centrally located orifice. The first aperture is formed in the first rotating plate intermediate the terminating edge and the orifice and is positioned at the pre-determined position of the first aperture. The second rotating plate is positioned within the orifice and is rotatably moveable between an initial position and a final position. The second aperture is formed in the second rotating plate at the pre-determined location of the second aperture. When the second rotating plate is in the initial position and the first rotating plate is in the first position, the closing member is in the open configuration and golf clubs can be positioned within or removed from the locking golf bag in the conventional manner. When the second rotating plate is in the final position and the first rotating plate is in the second position, the closing member is in the closed configuration and so golf clubs cannot be removed from the locking golf bag.

The closing member also operates in conjunction with the divider plate to provide support for golf clubs that are positioned either in the first opening or in the second opening. When the closing member is in the closed configuration, both the closed size of the first opening and the second effective size of the second opening are such that a shaft of a golf club positioned in the second opening is supported to about the same extent as a shaft of a golf club which is positioned in the first opening. Consequently, when the closing member is in the closed configuration, the closing member operates in conjunction with the divider plate so that a golf club which is positioned in the second opening is supported to an equivalent extent as a club that is positioned in the first openings.

The locking golf bag can also include an elongated strap which can be used to protect the golf bag against theft. A second end of the elongated strap is fixedly secured to the tubular wall near the closed bottom of the body portion. The locking member reversibly connects the first end of the elongated strap to the tubular wall. The locking golf bag can therefore be secured to an immovable object by looping the elongated strap about the object and then securing the first end of the strap to the locking member. The locking member thus not only helps to prevent theft of golf clubs from the locking golf bag but also helps to prevent theft of the locking golf bag itself.

DETAILED DESCRIPTION

Figure 1:
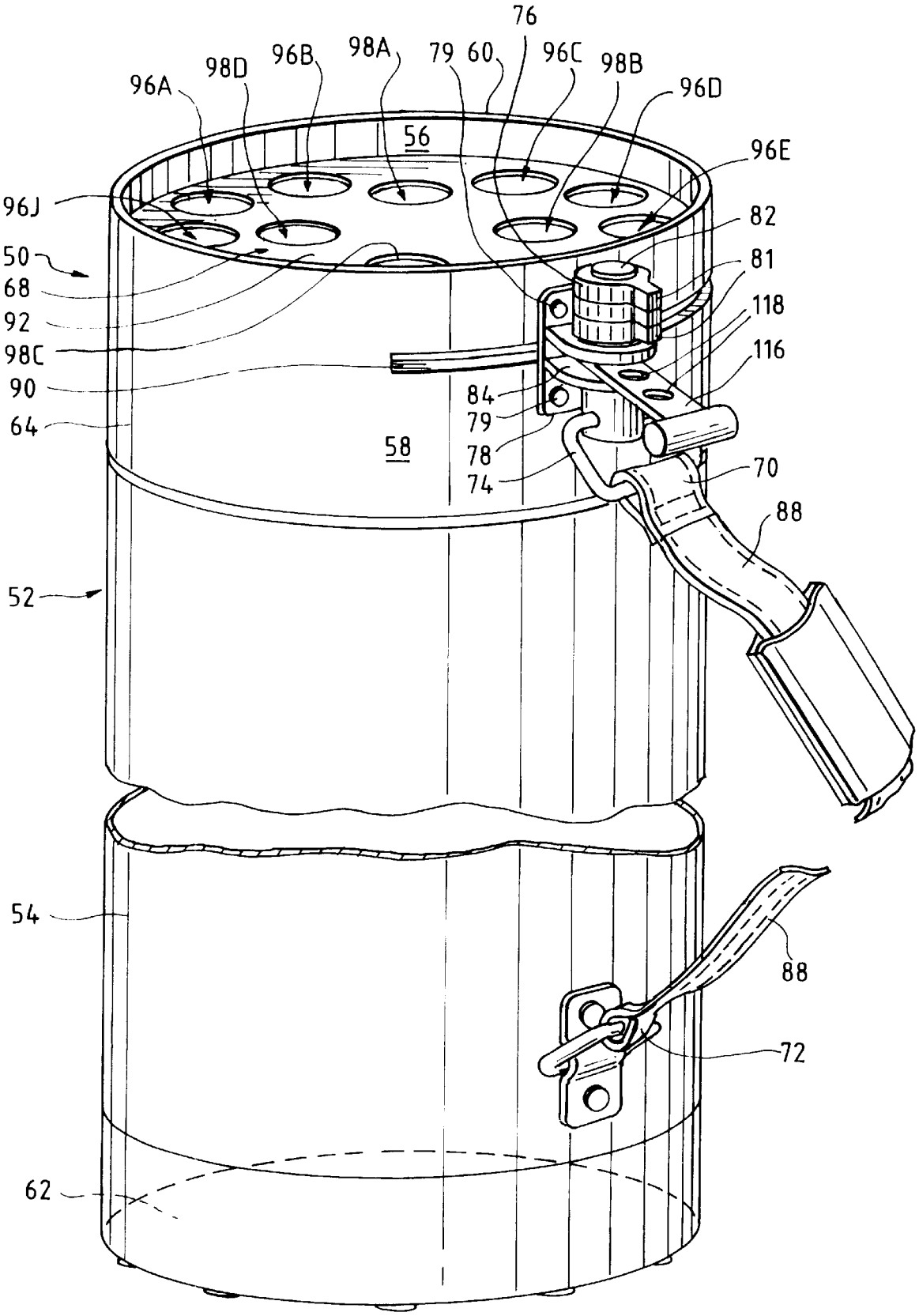
FIG. 1 is a perspective view of a locking golf bag according to the invention.
Figure 2:
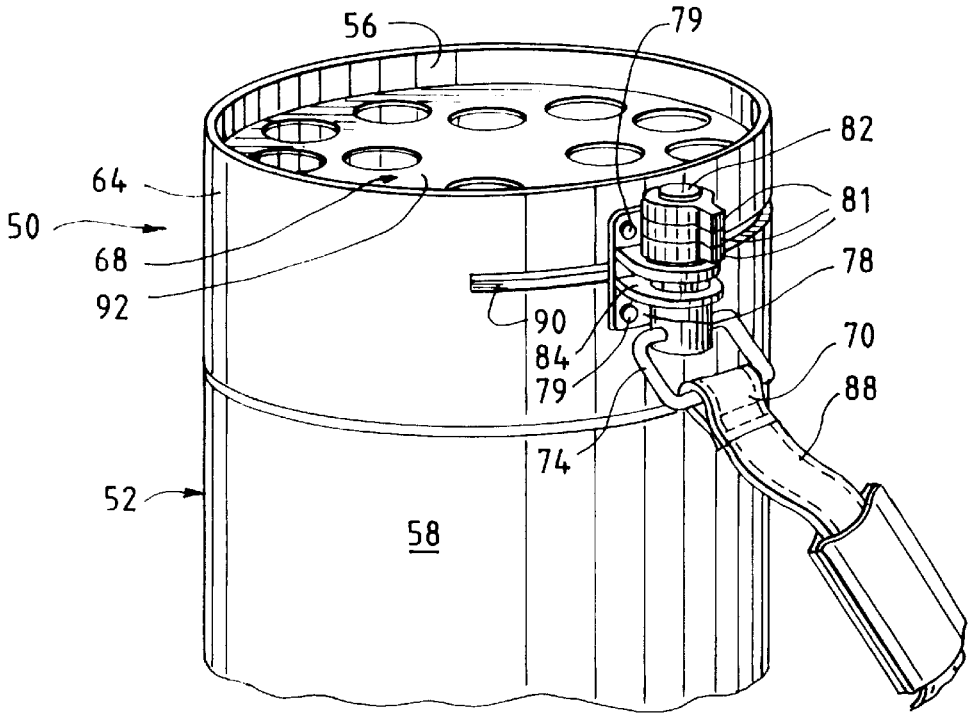
FIG. 2 is partial perspective view of the locking golf bag in FIG. 1 and shows a lock and a strap which forms a part of the locking golf bag.
Figure 3:
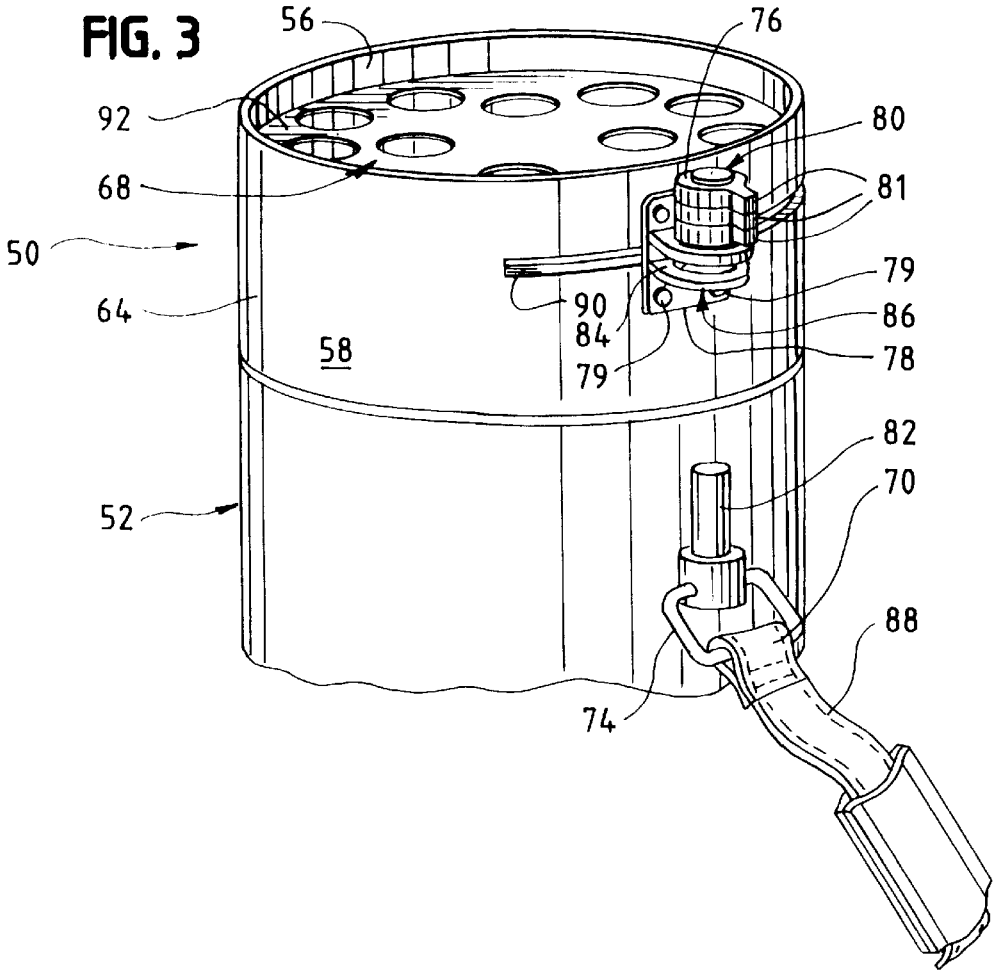
FIG. 3 is a partial perspective view of the locking golf bag in FIG. 1 and shows a first end of the strap in more detail.

Turning now to the drawings in which like reference numbers indicate like elements throughout, FIGS. 1–3 show a locking golf bag 50 according to the invention. The golf bag 50 includes a body portion 52 that has a tubular wall 54 with an inner surface 56, an outer surface 58, and an upper edge 60. The body portion 52 also includes a closed bottom 62 which is secured to the tubular wall 54 opposite the upper edge 60. The body portion 52 is sized to accommodate the number of golf clubs normally carried by conventional golfers. Under current golfing rules, golfers are usually limited to fourteen golf clubs. Consequently, in the preferred embodiment of the invention, the body portion 52 is sized to accommodate fourteen golf clubs, although the size of the body portion 52 can be adjusted to accommodate more clubs or fewer clubs. The body portion 52 is of conventional construction and can be made from any durable material, for example, from canvas, leather, plastic, or a combination of these materials. As is typical in golf bag construction, the body portion 52 includes a reinforced neck area 64 that is proximate the upper edge 60. The reinforced neck area 64 helps to stiffen the bag 50 so that clubs can be more readily removed from or inserted into the bag 50. The reinforced neck area 64 includes a tubular member 66 (shown in FIGS. 4 and 8) that is attached to the inner surface 56 of the tubular wall 54 along the reinforced neck area 64. The tubular member 66 can be made from any relatively stiff material and preferably is made from plastic. The tubular member 66 is attached to the inner surface 56 by any suitable method. For example, the tubular member 66 can be sewn in place or can be attached to the inner surface 56 by adhesive, rivets, or the like. Regardless of the specific type of attachment used, in the preferred embodiment the tubular member 66 is attached to the inner surface 56 so that an outer surface 67 of the tubular member 66 is essentially flush with the inner surface 56 of the tubular wall 54. The bag 50 also includes a divider plate, shown generally at 68, which is rigidly secured to the tubular wall 54 along the inner surface 56. As explained in more detail below, the divider plate 68 works in conjunction with a closing member 94 (shown in FIGS. 4 and 8) to lock golf clubs within the bag 50 and to provide support for golf clubs positioned in the bag 50.

The bag 50 can also include an elongated strap 70, a second end 72 of which is fixedly secured to the outer surface 58 of the tubular wall 54 near the closed bottom 62. A first end 74 of the strap is reversibly connected to the tubular wall 54 near the upper edge 60. This can be accomplished by any suitable reversible connecting member, for example, a buckle (not shown), that is secured to the tubular wall 54. In the preferred embodiment, however, a lock 76 is used to reversibly connect the first end 74 of the strap 70 to the tubular wall 54. FIGS. 2 and 3 show the lock 76 and the first end 74 of the strap 70 in more detail. In the preferred embodiment, the bag 50 includes a lock-plate 78 that is fixedly secured to the outer surface 58 along the reinforced neck area 64 by any suitable means, for example, by rivets 79, and the lock 76 is fixedly secured to the plate 78. In the preferred embodiment of the invention, both the lock-plate 78 and the lock 76 are metallic and the lock 76 is welded to the lock plate 78. In addition, although a standard padlock can be used, the lock 76 preferably is a tumbler combination lock that includes a central channel 80 (shown in FIG. 3) and tumblers 81. The preferred form of the strap 70 therefore also includes a rod 82 (shown in FIG. 3) that is firmly affixed to and extends from the first end 74 of the strap 70. The lock plate 78 can also include an outwardly extending tab 84 which has a hole 86 (shown in FIG. 3) that is aligned with the channel 80 (shown in FIG. 3). The tab 84 helps to protect the lock 76 and also provides a guide for the rod 82. The first end 74 of the strap 70 is secured to the bag 50 by inserting the rod 82 into the channel 80 and mixing the tumblers 81. Consequently, the strap 70 can be used to secure the bag 50 to an object, such as a tree or bracket, by looping the strap 70 about the object and subsequently securing the first end 74 to the bag 50. The strap 70 thus can be used to protect the bag 50 against theft. In addition, the strap 70 can include a metallic band 88 that is affixed to the strap 70 and extends between the first end 74 and the second end 72. The band 88 provides additional security against theft of the bag 50.

Figure 4:
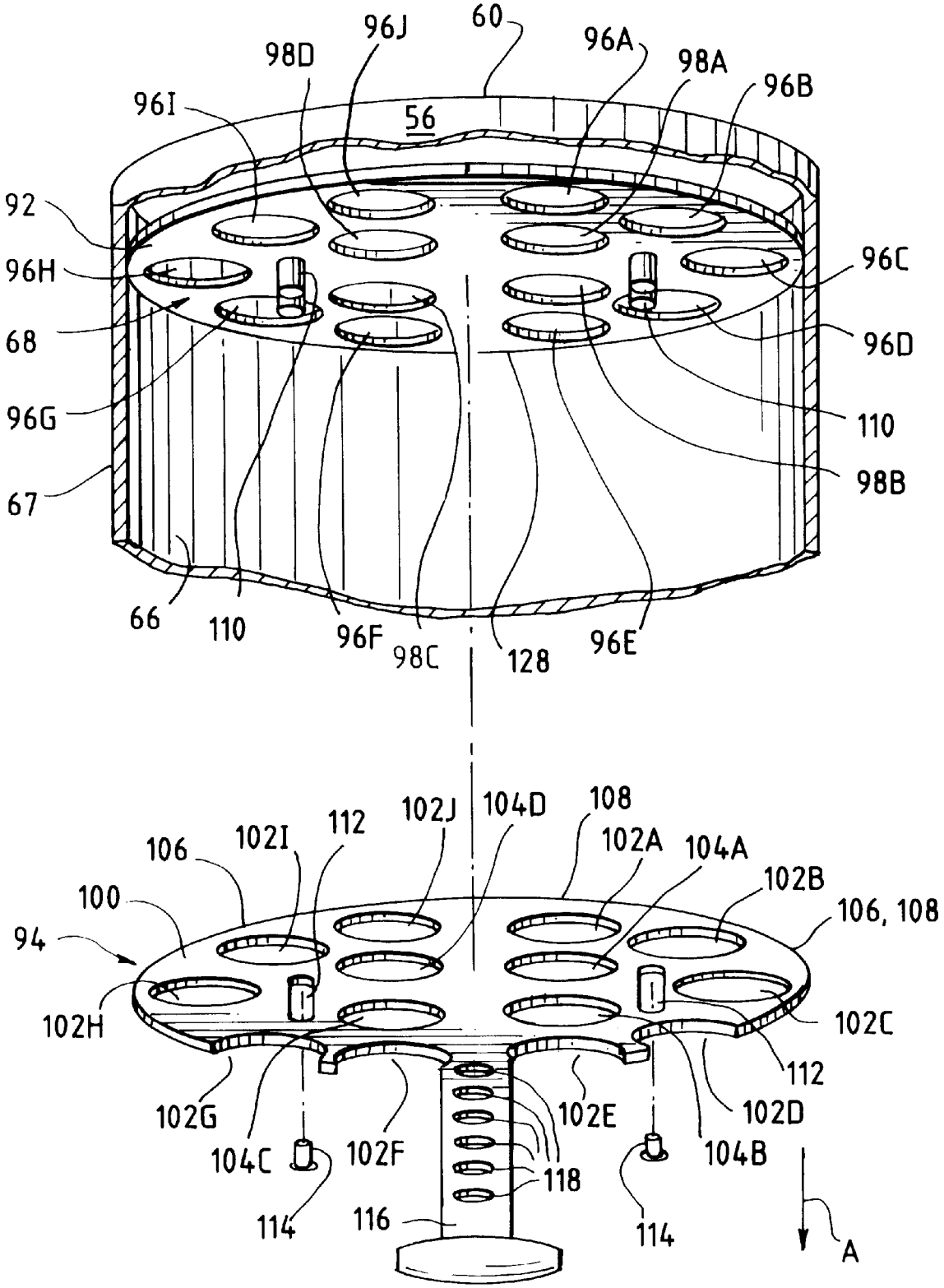
FIG. 4 is an exploded view of a divider plate and a closing member which form parts of the locking golf bag of FIG. 1.

In the preferred embodiment of the invention, the lock 76 also works in conjunction with the divider plate 68 and the closing member 94 (shown in FIGS. 4 and 8) to lock golf clubs within the bag 50 and to provide support for golf clubs positioned in the bag 50. The preferred form of the bag 50 therefore also includes a slot 90 formed in the tubular wall 54 and aligned with the lock-plate 78 and the lock 76. The slot 90 provides access to the closing member 94 so that the closing member 94 can be coupled to the lock 76. FIG. 4 shows the preferred embodiment of the closing member 94, as well as the preferred embodiment 92 of the divider plate 68. The divider plate 92 includes openings 96A–96J and 98A–98D that position golf clubs within the bag 50. The closing member 94 includes a slider plate 100 which has apertures 102A–102J and 104A–104D that also position golf clubs within the bag 50. A terminating edge 106 of the slider plate 100 defines an outer edge 108 of the closing member 94. The divider plate includes downwardly depending pins 110 that extend through slits 112 formed in the slider plate 100 to slidingly couple the slider plate 100 to the divider plate 92. Retaining heads 114 can be affixed to the pins 110 to keep the pins 1 110 positioned within the slits 112. The slider plate 100 is slidingly moveable along a pre-determined slider direction, shown as Arrow A, from a first position (shown in FIG. 7A) to a second position (shown in FIG. 7B). Consequently, the closing member 94 is moveable between an open configuration (shown in FIG. 7A) and a closed configuration (showed in FIG. 7B). When the slider plate 100 is in the second position so that the closing member 94 is in the closed configuration, golf clubs can be locked within the bag 50 and supported within the bag 50 so that the clubs do not suffer extensive wear. The slider plate 100 also includes a slider bar 116 that is used to move the slider plate 100 from the first position to the second position. Referring back to FIG. 1, the slider bar 116 extends through the slot 90 in the tubular wall 54 so that the user may move the slider plate 100 from the first position to the second position. The slider bar 116 also includes lock holes 118 (shown in FIG. 4) that are sized to receive the strap rod 82. The slider plate 100 therefore can be locked in the second position by inserting the rod 82 through an appropriate one of the lock holes 118 and subsequently inserting the rod 82 into the channel 80 of the lock 76 and mixing the tumblers 81.

As previously noted, in the preferred embodiment of the invention, the body portion 52 of the golf bag 50 is sized to accommodate fourteen golf clubs. This can be done by positioning the openings 96A–96J and 98A–98D of the preferred embodiment 92 of the divider plate 68 along a common line. However, such as arrangement can require a large body portion 52 which could tend to make the golf bag 50 unwieldy. Consequently, in the preferred embodiment of the invention the openings 96A–96J and 98A–98D are tiered to minimize the size of the preferred embodiment 92 of the divider plate 68 and hence of the golf bag 50. It should be noted that in the preferred embodiment of the invention, the divider plate 68 is substantially circular, as is the upper edge 60. When the divider plate 68 is circular, the size of the divider plate 68 is simply the diameter thereof which, in the preferred embodiment, is on the order of 8 inches long. Other shapes for the divider plate 68 are possible, however. For example, the divider plate 68 could be square in which case the size of the divider plate would be determined by the length of one side thereof. Regardless of the shape used, in the preferred embodiment of the invention, the openings 96A–96J and 98A–98D are tiered so as to minimize the size of the preferred embodiment 92 of the divider plate 68 needed to accommodate the desired number of golf clubs.

Figure 5:
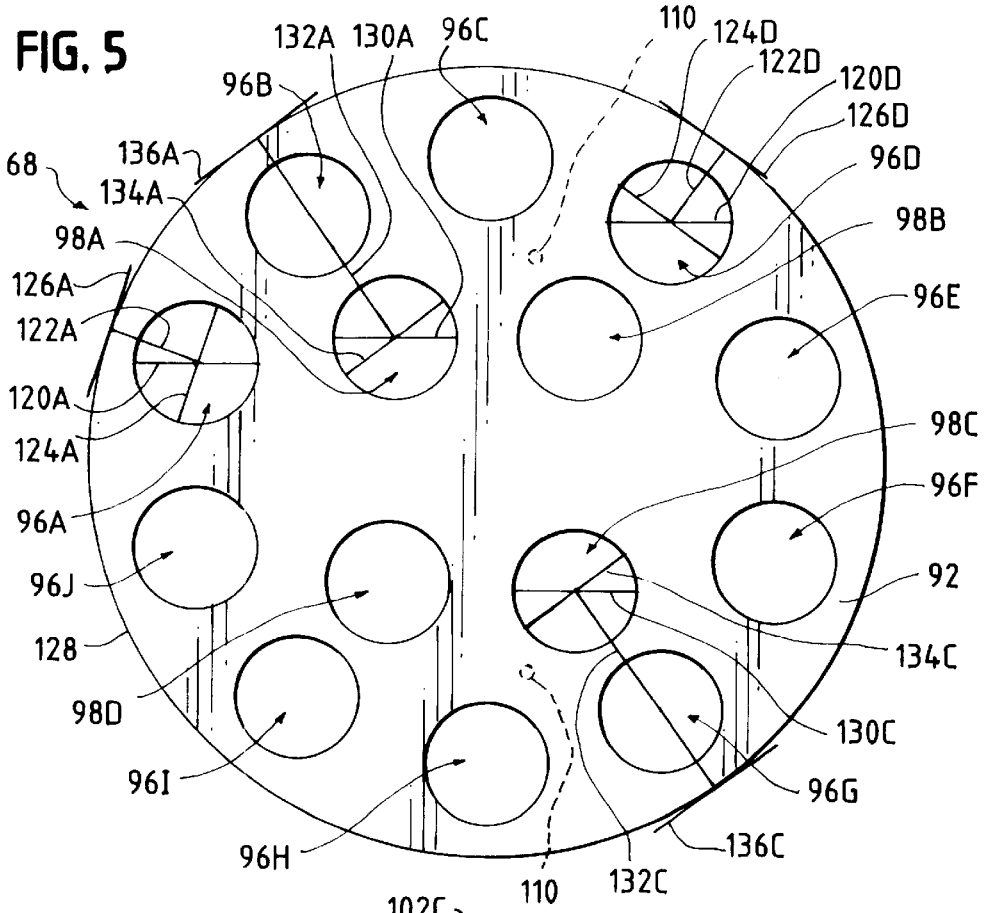
FIG. 5 is a top plan view of the divider plate shown in FIG. 4.

FIGS. 4 and 5 show the preferred embodiment 92 of the divider plate 68 in more detail. The openings 96A–96J form one tier and the openings 98A–98D form a second tier. In the preferred embodiment of the invention, the characteristics of each opening in a given tier are equivalent. Thus, for example, the characteristics of the opening 96A and those of 96D are equivalent. For ease of explanation, the characteristics of the openings 96A–96J in the first tier will be discussed with reference to one specific opening, for example, 96A, although it is to be understood that the other first tier openings 96B–96J have equivalent characteristics. Similarly, in the preferred embodiment of the invention, the characteristics of the second tier openings 98A–98D are equivalent. Thus, for example, the characteristics of the opening 98A and those of 98C are equivalent. For ease of explanation, the characteristics of the openings 98A–98D in the second tier will be discussed with reference to one specific opening, for example, 98A, although it is to be understood that the other second tier openings 98B–98D have equivalent characteristics.

The characteristics of the first tier opening 96A are as follows. First, as shown in FIG. 5, the opening 96A has a pre-determined size that equals the length of a size line 120A that spans the opening 96A and is aligned with the slider direction A. In the preferred embodiment of the invention, the opening 96A is substantially circular and so the length of the size line 120A substantially equals the diameter of the opening 96A. However, other shapes are possible for the opening 96A. For example, the opening 96A could be a parallelogram which is positioned on the divider plate 92 so that one edge of the opening 96A is aligned with the slider direction A, in which case the length of the size line 120A would be substantially equal to the length of the aligned edge. Alternatively, the opening 96A could be a parallelogram which is positioned on the divider plate 92 so that a diagonal line is aligned with the slider direction A, in which case the length of the size line 120A would be substantially equal to length of the diagonal line. Regardless of the shape of the opening 96A, the length of the size line 120A, and hence the size of the opening 96A, is chosen to accommodate the handle portions of golf clubs. In general, conventional golf clubs have handle portions with diameters on the order of 1.25 inches. Consequently, the length of the size line 120A, and hence the pre-determined size of the opening 96A, preferably is at least 1.25 inches. Second, the opening 96A is positioned at a first pre-determined distance from the inner surface 56 of the tubular wall 54. The magnitude of the first pre-determined distance equals the length of a position line 122A which extends from the inner surface 56 of the tubular wall 54 to a first reference line 124A that spans the opening 96A and is substantially parallel with a second reference line 126A which intersects an outer edge 128 of the divider plate 92 without crossing the outer edge 128. When the divider plate 68 is substantially circular, as is the preferred embodiment 92, the second reference line 126A is tangent to the outer edge 128. Alternatively, if the divider plate 68 were a parallelogram, the second reference line 126A would be coincident with an appropriate one of the four sides of the divider plate 68. It should be noted that the tubular member 66 is relatively thin so that the thickness of the tubular member 66 does not contribute significantly to the length of the position line 122A. The length of the position line 122A is thus determined primarily by the size of the divider plate 92 which, as previously noted, is on the order of 8 inches. To provide adequate clearance between the outer edge 128 and the opening 96A, the length of the position line 122A is preferably on the order of 0.9 inches.

The characteristics of the second tier opening 98A are as follows. First, the opening 98A has a pre-determined size which equals the length of a size line 130A that spans the opening 98A and is aligned with the slider direction A. In the preferred embodiment of the invention, the opening 98A is substantially circular and so the length of the size line 130A substantially equals the diameter of the opening 98A. However, other shapes are possible for the opening 98A. For example, the opening 98A could be a parallelogram which is positioned on the divider plate 92 so that one edge of the opening 98A is aligned with the slider direction A, in which case the length of the size line 130A would be substantially equal to the length of the aligned edge. Alternatively, the opening 98A could be a parallelogram which is positioned on the divider plate 92 so that a diagonal line is aligned with the slider direction A, in which case the length of the size line 130A would be substantially equal to length of the aligned diagonal line. Regardless of the shape of the opening 98A, the length of the size line 130A, and hence the size of the opening 98A, is chosen to accommodate the handle portions of golf clubs and so is preferably at least 1.25 inches. Second, the opening 98A is positioned at a second pre-determined distance from the inner surface 56 of the tubular wall 54. The magnitude of the second pre-determined distance equals the length of a position line 132A which extends from the inner surface 56 of the tubular wall 54 to a first reference line 134A that spans the opening 98A and is substantially parallel with a second reference line 136A which intersects the outer edge 128 of the divider plate 92 without crossing the outer edge 128. The thickness of the tubular member 66 does not contribute significantly to the length of the position line 132A. The length of the position line 132A thus is determined primarily by the size of the divider plate 92. To create the second tier and to provide adequate clearance between the opening 98A and adjacent first tier openings, such as the opening 96B, the length of the position line 132A is preferably on the order of 2.4 inches. It can thus be seen that the pre-determined distance of the first tier opening 96A from the tubular wall 54 is greater than the pre-determined distance of the second tier opening 98A from the tubular wall 54.

Figure 6:
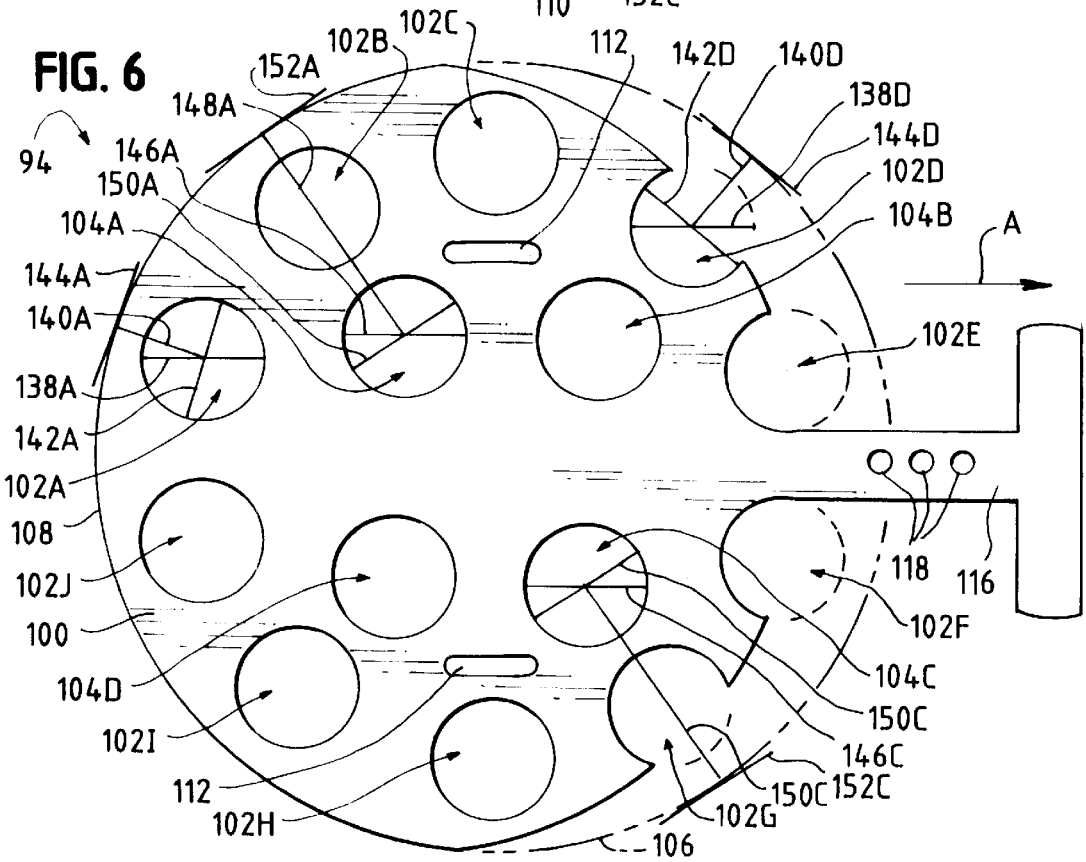
FIG. 6 is a top plan view of the closing member shown in FIG. 4.

FIGS. 4 and 6 show slider plate 100 of the preferred embodiment of the closing member 94 in more detail. To minimize the size of the slider plate 100 needed to accommodate the desired number of golf clubs, the apertures 102A–102J and the apertures 104A–104D are tiered so that the apertures 102A–102J form a first tier and the apertures 104A–104D form a second tier. In the preferred embodiment of the invention, the characteristics of each aperture in a given tier are equivalent. Thus, for example, the characteristics of the first tier aperture 102A and those of the first tier aperture 102C are equivalent. For ease of explanation, the characteristics of the apertures 102A–102J in the first tier will be discussed with reference to one specific aperture, for example, the aperture 102A, although it is to be understood that the other first tier apertures 102B-102J have equivalent characteristics. Similarly, in the preferred embodiment of the invention, the characteristics of each aperture in the second tier are equivalent. Thus, for example, the characteristics of the second tier aperture 104A and those of the second tier aperture 102B are equivalent. For ease of explanation, the characteristics of the apertures 104A–104D in the second tier will be discussed with reference to one specific aperture, for example, the second tier aperture 104A, although it is to be understood that the other second tier apertures 104B–104D have equivalent characteristics.

The characteristics of the first tier aperture 102A are as follows. First, the aperture 102A has a pre-determined size that equals the length of a size line 138A that spans the aperture 102A and is generally aligned with the slider direction A. The length of the size line 138A, and hence the size of the aperture 102A, is chosen to accommodate the handle portions of golf clubs and so is preferably at least 1.25 inches. Second, the aperture 102A is located at a pre-determined position which is at a first pre-determined distance from the terminating edge 106 of the slider plate 100 and hence from the outer edge 108 of the closing member 94. The magnitude of the first pre-determined distance equals the length of a position line 140A which extends from the terminating edge 106 of the slider plate 100 to a first reference line 142A that spans the opening 98A and is substantially parallel with a second reference line 144A that intersects the terminating edge 106 of the slider plate 100 without crossing the terminating edge 106. It should be noted that in the preferred embodiment of the invention, the slider plate 100 is not symmetrical but instead is foreshortened in the pre-determined slider direction A. This foreshortening of the slider plate 100 provides clearance for the movement of the slider plate 100 in the slider direction A. In the foreshortened region, for example, near the apertures 102D–102G, the terminating edge 106 is defined as the edge the slider plate 100 would have if the slider plate 100 were symmetrical. This "virtual" portion of the terminating edge 106 of the slider plate 100 is shown in dashed line in FIG. 6. Moreover, in the preferred embodiment of the invention, the terminating edge 106 of the slider plate 100 does not extend beyond the outer edge 128 of the divider plate 92. Consequently, the size of the slider plate 100 approaches that of the divider plate 92. The length of the position line 140A therefore is determined primarily by the size of the divider plate 92. To provide adequate clearance between the terminating edge 106 of the slider plate 100 and the first tier aperture 102A, the length of the position line 140A is preferably on the order of 0.9 inches.

The characteristics of the second tier apertures 104A–D are now discussed with reference to the aperture 104A. First, the aperture 104A has a pre-determined size that equals the length of a size line 146A that spans the aperture 104A and is generally aligned with the slider direction A. The length of the size line 146A, and hence the size of the aperture 104A, is chosen to accommodate the handle portions of golf clubs. Consequently, the length of the size line 146A, and hence the pre-determined size of the aperture 104A, preferably is at least 1.25 inches. Second, the aperture 104A is positioned at a pre-determined location which is at a second pre-determined distance from the terminating edge 106 of the slider plate 100 and hence from the outer edge 108 of the closing member 94. The magnitude of the second pre-determined distance equals the length of a position line 148A which extends from the terminating edge 106 of the slider plate 100 to a first reference line 150A that spans the aperture 104A and is substantially parallel with a second reference line 152A which intersects the terminating edge 106 of the slider plate 100 without crossing the terminating edge 106. As with the first tier apertures 102A–102J, the length of the position line 148A is determined primarily by the size of the divider plate 92. To create the second tier and to provide adequate clearance between the second tier aperture 104A and adjacent first tier apertures, such as the aperture 102B, the length of the position line 148A is preferably on the order of 2.4 inches.

Figure 7A:
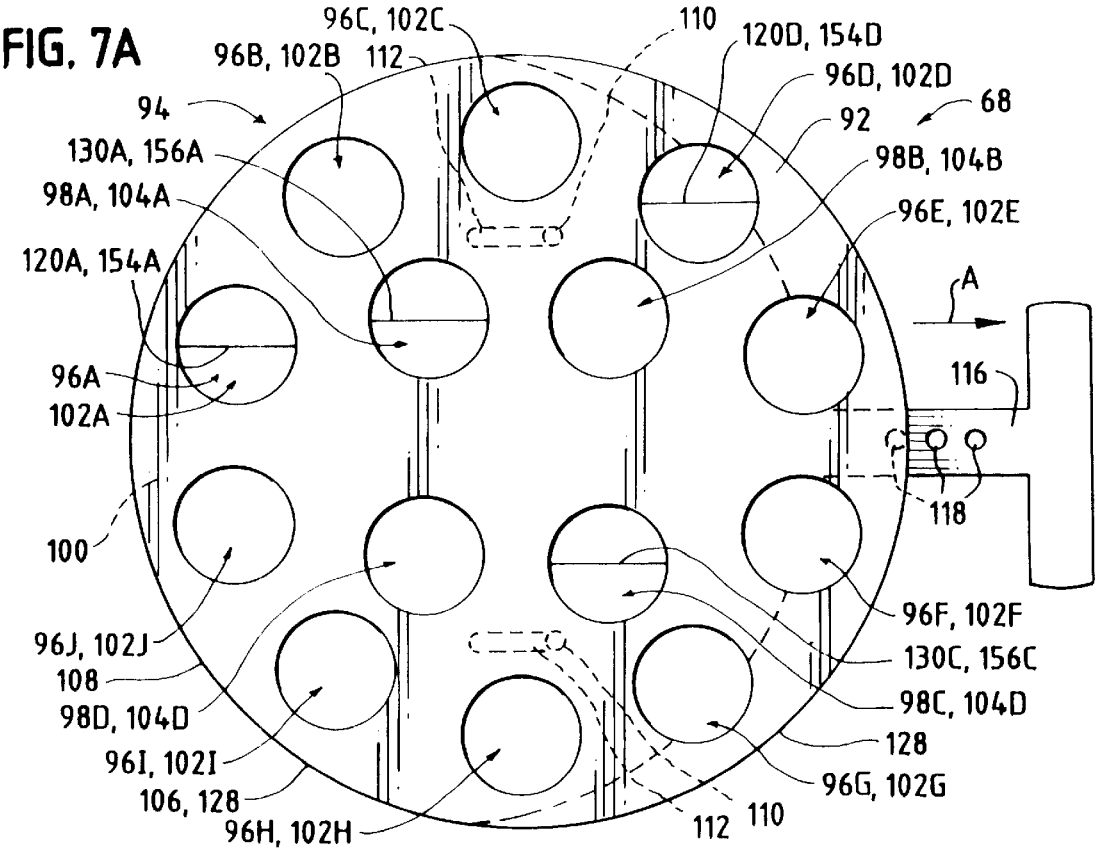
FIG. 7A is a top plan view of the divider plate shown in FIGS. 4 and 5 superimposed over the closing member shown in FIGS. 4 and 5 and illustrates an open configuration of the closing member.

The operation of the divider plate 92 and the slider plate 100 are now explained with reference to FIGS. 7A and 7B. FIG. 7A shows the divider plate 92 superimposed on the slider plate 100 when the slider plate 100 is in the first position. In this first position, the first tier aperture 102A of the slider plate 100 is aligned with the first tier opening 96A of the divider plate 92 so that the opening 96A has an open size which equals the length of an open size line 154A that both spans the opening 96A and is generally aligned with the slider direction A when the slider plate 100 is in the first position. In the preferred embodiment of the invention, the open size line 154A is generally coincident with the size line 120A when the slider plate 100 is in the first position. The length of the open size line 154A should accommodate the handle portions of conventional golf clubs and so preferably is at least 1.25 inches long. Similarly, the second tier aperture 104A is aligned with the second tier opening 98A so that the opening 98A has a first effective size which is equals the length of a first effective size line 156A that both spans the aperture 104A and is generally aligned with the slider direction A when the slider plate 100 is in the first position. In the preferred embodiment of the invention, the first effective size line 156A is generally coincident with the size line 130A when the slider plate 100 in the first position. As with the open size line 154A, the first effective size line 156A is at least 1.25 inches long. When the slider plate 100 is in the first position shown in FIG. 7A, the closing member 94 is in the open configuration in which golf clubs may be placed within or removed from the golf bag 50 (shown in FIG. 1) in the conventional manner where the handle portions are positioned within the bag 50 and the club head portions of the clubs extend from the bag 50. The open size of the first tier openings 96A–96J, such as the opening 96A, and the first effective size of the second tier openings 98A–98D, such as the opening 98A, are thus chosen to readily accommodate the handle portions of conventional golf clubs.

Figure 7B:
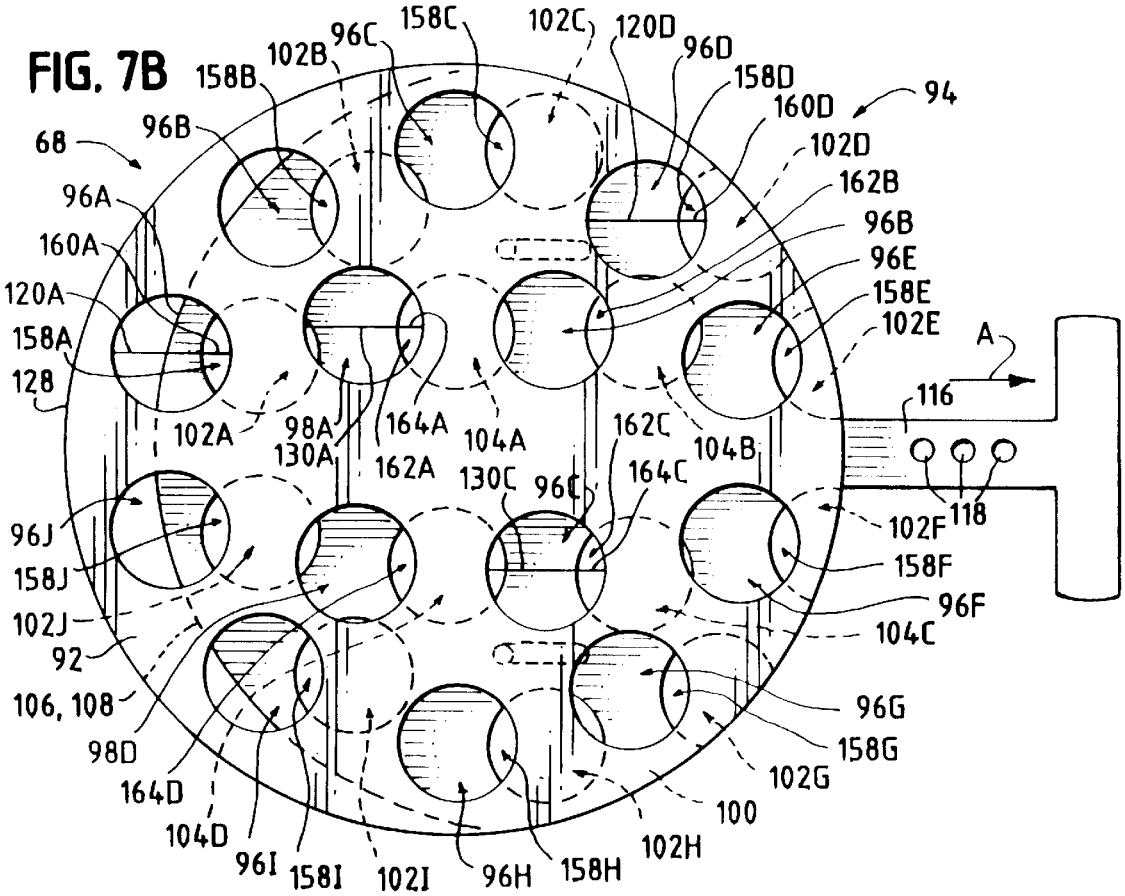
FIG. 7B is a top plan view of the divider plate shown in FIGS. 4 and 5 superimposed over the closing member shown in FIGS. 4 and 5 and illustrates a closed configuration of the closing member.

In FIG. 7B, the slider plate 100 has been moved in the slider direction A to the second position. In this second position of the slider plate 100, the first tier aperture 102A of the slider plate 100 is aligned with the first tier opening 96A of the divider plate 92 so that a portion 158A of the aperture 102A is exposed and provides access into the bag 50. The first tier opening 96A consequently has a closed size which equals the length of a closed size line 160A that spans the exposed portion 158A and is generally aligned with the slider direction A when the slider plate 100 is in the second position. Similarly, the second tier aperture 104A is aligned with the second tier opening 98A so that a portion 162A of the aperture 104A is exposed and provides access onto the bag 50. Consequently, the second tier opening 98A has a second effective size which equals the length of a second effective size line 164A that spans the exposed portion 162A and is generally aligned with the slider direction A when the slider plate 100 in the second position. As can be seen by comparing FIGS. 7A and 7B, the length of the closed size line 160A is less than the length of the open size line 154A. The closed size of the first tier opening 96A is thus less than the open size of the opening 96A. Similarly, the length of the second effective size line 164A of the second tier opening 98A is less than the length of the first effective size line 156A so that the second effective size of the opening 98A is less than the first effective size of the opening 98A. Both the closed size of the first tier opening 96A and the second effective size of the second tier opening 98A are such that handle portions of conventional golf clubs cannot fit through the exposed portions 158A and 162A of the apertures 102A and 104A, respectively. Thus, when the slider plate 100 is in the second position shown in FIG. 7B, the closing member 94 is in the closed configuration in which golf clubs cannot be removed from the bag 50. Moreover, the closing member 94 can be locked in the closed configuration shown in FIG. 7B by first inserting the strap rod 82 (shown in FIG. 3) through an appropriate one of the lock holes 118 before inserting the rod 82 into the channel 80 of the lock 76 (shown in FIG. 2) and mixing the tumblers 81. It can thus be seen that the closing member 94 operates in conjunction with the divider plate 68 to help to prevent theft of golf clubs from the bag 50.

The closing member 94 also operates in conjunction with the divider plate 68 to provide support for golf clubs that are positioned either in the first tier openings 96A–96J or in the second tier openings 98A–98D. The shafts of conventional golf clubs generally decrease in diameter from the handle portion to the club head. In the preferred embodiment of the invention, when the closing member 94 is in the closed configuration shown in FIG. 7B, both the closed size of the first tier openings 96A–96J and the second effective size of the second tier openings 98A–98D are such that a shaft of a golf club positioned in one of the second tier openings 96A–96J, such as the opening 96A, is supported to about the same extent as a shaft of a golf club which is positioned in one of the first tier openings 96A–96J, such as the opening 96A. Preferably, the closed sizes of the first tier openings 96A–96J, such as the opening 96A, are within a range of about 35 to about 45 percent of the open sizes of the openings 96A–96J and the second effective sizes of the second tier openings 98A–98D, such as the opening 98A, are within a range of about 35 to about 45 percent of the first effective sizes. In particular, the length of the closed size line 160A is preferably about 0.5 inches, as is the length of the second effective size line 164A. Thus, when the length of the open size line 154A is on the order of 1.25 inches, the closed size of the opening 96A is about 40 percent of the open size of the opening 96A. Similarly, when the length of the first effective size line 156A is on the order of 1.25 inches and the length of the second effective size line 164A is on the order of 0.5 inches, the second effective size of the opening 98A is about 40 percent of the first effective size. It can thus be seen that when the closing member 94 is in the closed configuration shown in FIG. 7B, the closing member 94 operates in conjunction with the divider plate 68 so that golf clubs which are positioned in the second tier openings 98A–98D are supported to an equivalent extent as are clubs that are positioned in the first tier openings 92A–92J.

Figure 8:
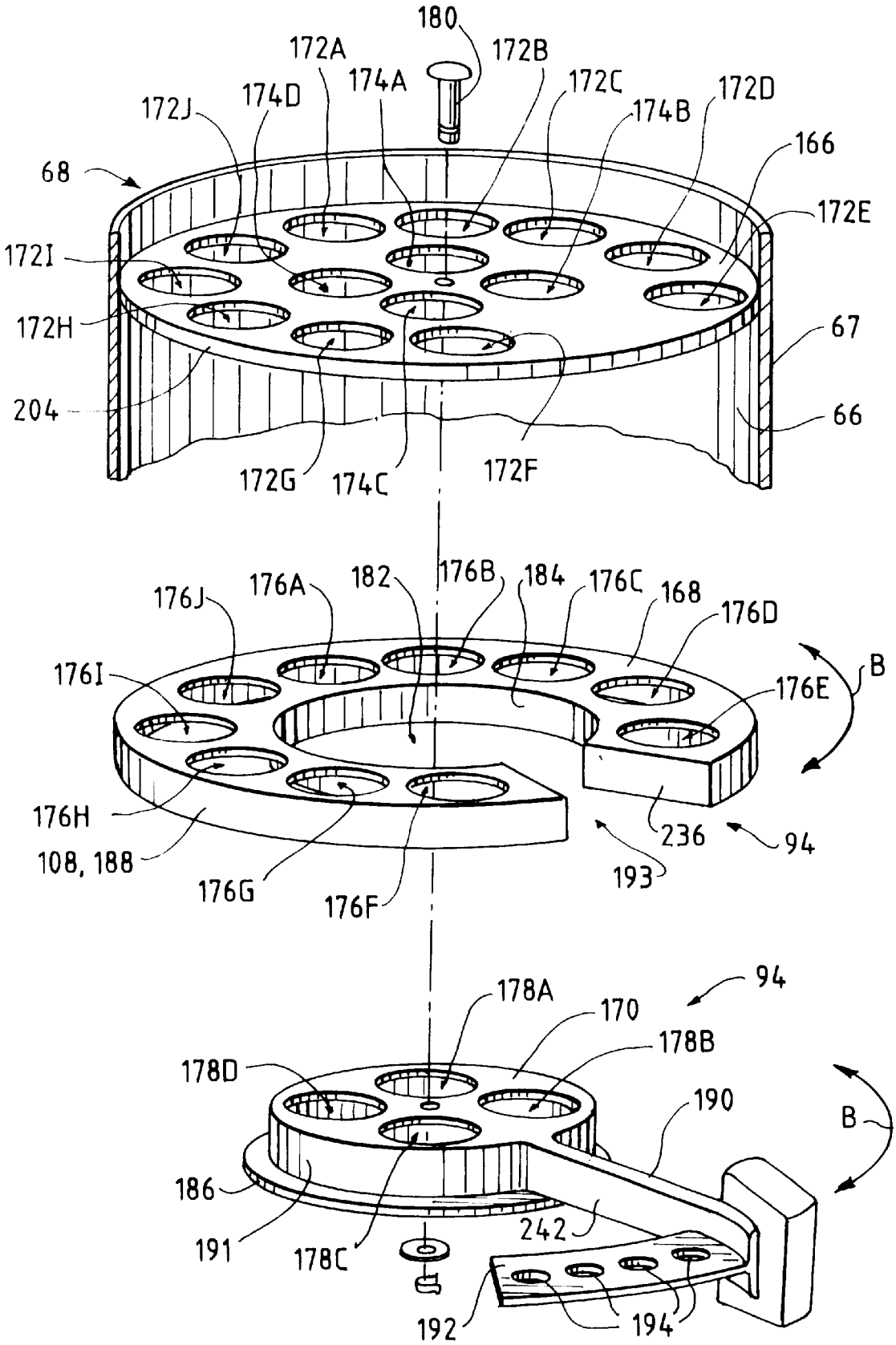
FIG. 8 is an exploded view an alternative embodiment of a divider plate and an alternative embodiment of a closing member which form parts of the golf bag of FIG. 1.

FIG. 8 shows an alternative embodiment 166 of the divider plate 68 and an alternative embodiment of the closing member 94 which, in this case, includes a first rotating plate 168 and a second rotating plate 170. Similar to the previous embodiment 92, the divider plate 166 includes openings 172A–172J and 174A–174D that position golf clubs within the bag 50 (shown in FIG. 1). To minimize the size of the divider plate 68 needed to accommodate the desired number of golf clubs, the openings 172A–172J and 174A–174D are tiered, with the openings 172A–172J forming the first tier and the openings 174A–174D forming the second tier. The closing member 94 also includes apertures 176A–176J and 178A–178D that help to position golf clubs within the bag 50. Specifically, the first tier apertures 176A–176J are formed in the first rotating plate 168 and the second tier openings 178A–178D are formed in the second rotating plate 170. The second rotating plate 170 is rotatably coupled to the divider plate 166 by any appropriate means. For example, as shown in FIG. 8, a centrally-located pin 180 extends from the divider plate 166 to the second rotating plate 170 which is rotatably mounted thereon. The second rotating plate 170 is positioned within an orifice 182 that is defined by an inner edge 184 of the first rotating plate 168. In the preferred form of the invention, the second rotating plate 170 also includes an outwardly extending flange 186 that supports the first rotating plate 168. The first rotating plate 168 also has a terminating edge 188 that defines the outer edge 108 of the closing member 94.

As is explained in more detail below, the first rotating plate 168 is rotatably moveable in a rotator direction, shown as Arrow B, between a first position (shown in FIG. 12A) and a second position (shown in FIG. 12C) and the second rotating plate 170 is rotatably moveable in the rotator direction B between an initial position (shown in FIG. 12A) and a final position (shown in FIG. 12C). The closing member 94 is in an open configuration (shown in FIG. 12A) when the first rotating plate 168 is in the first position and the second rotating plate 170 is in the initial position. Moving the second rotating plate 170 to the final position and moving the first rotating plate 168 to the second position moves the closing member 94 to a closed configuration (shown in FIG. 12C). In so doing, golf clubs can be locked within the bag 50 and can be supported within the bag 50 so that the clubs do not suffer from extensive wear. The second rotating plate 170 includes an arm 190 that is used by the user to move the second rotating plate 170 from the initial position to the final position. The arm 190 extends from an outer edge 191 of the second rotating plate 170 through a passageway 193 formed in the first rotating plate 168 and through the slot 90 (shown in FIG. 3) in the tubular wall 54 so that the user can move the second rotating plate 170 to the final position. An outwardly extending locking bar 192 is affixed to the arm 190 and is positioned on the arm 190 so that the locking bar 192 is intermediate the arm 190 and the lock 76 when the arm 190 extends through the slot 90. The locking bar 192 includes lock holes 194 that are sized to receive the strap rod 82 (shown in FIG. 2). The second rotating plate 170 therefore can be locked in the final position by inserting the rod 82 through an appropriate one of the lock holes 194 and subsequently inserting the rod 82 into the channel 80 of the lock 76 and mixing the tumblers 81.

Figure 9:
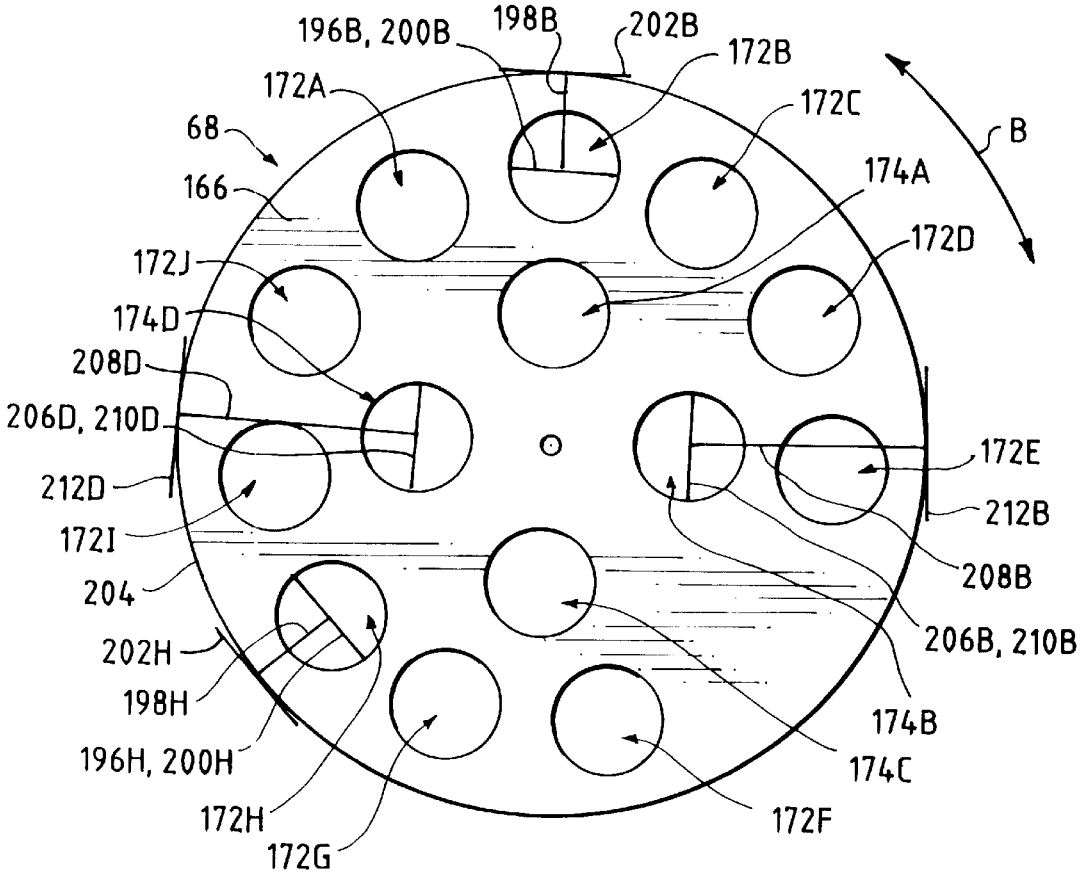
FIG. 9 is a top plan view of the divider plate of FIG. 8.

FIG. 9 shows the first alternative embodiment 166 of the divider plate 68 in more detail. In order to minimize the size of the divider plate 68 and of the golf bag 50 (shown in FIG. 1), the divider plate 166 preferably is substantially circular in which case the size of the divider plate 68, 166 is simply the diameter thereof which preferably is about 8 inches long. However, as with the previous embodiment 92, the divider plate 166 can have other shapes. Regardless of the shape used, the openings 172A–172J and 174A–174D preferably are tiered to minimize the size of the divider plate 166. It should be noted that the openings 172A–172J in the first tier are not equally spaced about the divider plate 166. Specifically, the openings 172A–172J are formed in the divider plate 166 so that the distance between two of the openings 172A–172J, for example the openings 172E and 172F, is greater than the space between other adjacent first tier openings 172A–172J, for example, between the opening 172A and the opening 172J or between the opening 172G and the opening 172H. In the preferred embodiment of the divider plate 166. the openings 172E and 172F are separated by an arc of about 50°, as measured along an outer edge 204 of the divider plate 166. The spacing between any two other adjacent first tier openings 172A–172J is preferably equal to an arc of about 31°, as measured along the outside edge 204. For example, the openings 172D and 172E are separated by an arc of about 31° degrees, as are the openings 172J and 172A. As is explained in more detail below, a relatively large separation between the opening 172E and the opening 172F is needed because the second rotating plate 170 (shown in FIGS. 8, 11, and 12A–12C) initially rotates independently of the first rotating plate 178.

The characteristics of the first tier openings 172A–172J are preferably equivalent and will now be explained with reference to the opening 172B. First, the opening 172B has a pre-determined size that equals the length of a size line 196B that spans the opening 172B and is generally aligned with the rotator direction B. In the preferred embodiment of the divider plate 166, the opening 172B is substantially circular and so the length of the size line 196B substantially equals the diameter of the opening 172B. However, as with the openings 96A–96J and 98A–98D of the previous embodiment 92, other shapes are possible for the opening 172B. Regardless of the shape of the opening 172B, the length of the size line 196B, and hence the size of the opening 172B, is chosen to accommodate the handle portions of golf clubs. Consequently, the length of the size line 196B, and hence the pre-determined size of the opening 172B, preferably is at least 1.25 inches. Second, the opening 172B is positioned at a first pre-determined distance from the inner surface 56 of the tubular wall 54. The magnitude of the first pre-determined distance equals the length of a position line 198B which extends from the inner surface 56 of the tubular wall 54 to a first reference line 200B which spans the opening 172B and is substantially parallel with a second reference line 202B which intersects an outer edge 204 of the divider plate 166 without crossing the outer edge 204. When the divider plate 68 is substantially circular, as is the preferred embodiment of the divider plate 166, the second reference line 202B is tangent to the outer edge 204. Alternatively if the divider plate 68 were a parallelogram, the second reference line 202B would be coincident with an appropriate one of the four sides of the divider plate 68. Since the tubular member 66 is relatively thin, the thickness of the tubular member 66 does not contribute significantly to the length of the position line 198B. The length of the position line 198B is thus determined primarily by the size of the divider plate 166 which, as previously noted, is on the order of 8 inches. To provide adequate clearance between the outer edge 204 and the opening 172B, the length of the position line 198B is preferably on the order of 0.9 inches.

The characteristics of the second tier openings 174A–174D are preferably equivalent and will now be discussed with reference to the opening 174B. First, the opening 174B has a pre-determined size which equals the length of a size line 206B that spans the opening 174B and is generally aligned with the rotator direction B. In the preferred embodiment of the divider plate 166, the opening 174B is substantially circular and so the length of the size line 206B substantially equals the diameter of the opening 174B. However, as with the openings 96A–96J and 98A–98D of the previous embodiment 92, other shapes are possible for the opening 174B. Regardless of the shape of the opening 174B, the length of the size line 206B, and hence the size of the opening 174B, is chosen to accommodate the handle portions of golf clubs and so is preferably at least 1.25 inches. Second, the opening 174B is positioned at a second pre-determined distance from the inner surface 56 of the tubular wall 54. The magnitude of the second pre-determined distance equals the length of a position line 208B which extends from the inner surface 56 of the tubular wall 54 to a first reference line 210B which spans the opening 174B and is substantially parallel with a second reference line 212B which intersects the outer edge 204 of the divider plate 166 without crossing the outer edge 204. The length of the position line 208B is determined primarily by the size of the divider plate 166. To create the second tier and to provide adequate clearance between the second tier opening 174B and adjacent first tier openings, such as the opening 172D, the length of the position line 208B is preferably on the order of 2.5 inches.

Figure 10:
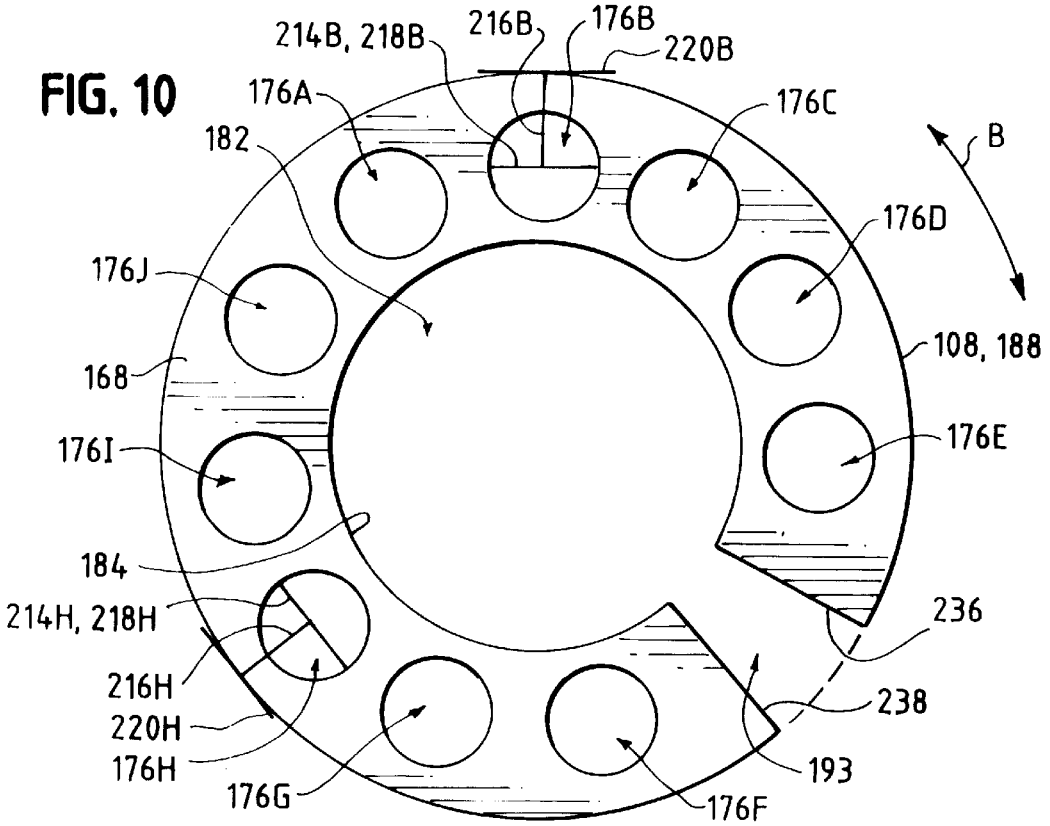
FIG. 10 is a top plan view of a first rotating plate that forms a part of the closing member of FIG. 8.
Figure 11:
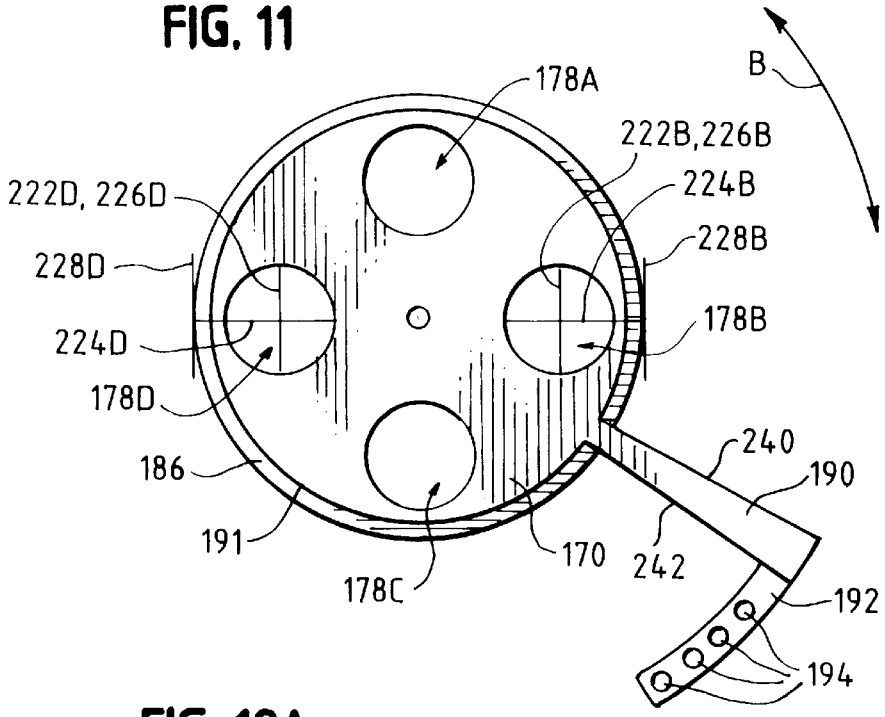
FIG. 11 is a top plan view of a second rotating plate that forms a part of the closing member shown in FIG. 8.

FIG. 10 shows the preferred embodiment of the first rotating plate 168 which is a part of the alternative embodiment of the closing member 94. As previously noted, the first tier apertures 176A–176J are formed in the first rotating plate 168. The characteristics of the first tier apertures 176A–176J, which are preferably equivalent, will be discussed with reference to the aperture 174B. The aperture 174B has a pre-determined size which equals the length of a size line 214B that spans the aperture 174B and is generally aligned with the rotator direction B. The length of the size line 214B, and hence the size of the aperture 174B, is chosen to accommodate the handle portions of golf clubs and so is preferably at least 1.25 inches. The aperture 174B is located at a pre-determined position which is at a first pre-determined distance from the terminating edge 188 of the first rotating plate 168 and hence from the outer edge 108 of the closing member 94. The magnitude of the first pre-determined distance equals the length of a position line 216B which extends from the terminating edge 188 of the first rotating plate 168 to a first reference line 218B that spans the opening 174B and is substantially parallel with a second reference line 220B that intersects the terminating edge 188 of the first rotating plate 168 without crossing the terminating edge 188. In the preferred embodiments of the divider plate 166 and of the first rotating plate 168, the terminating edge 188 of the first rotating plate 168 does not extend beyond the outer edge 204 of the divider plate 166. The length of the position line 216B therefore is determined primarily by the size of the divider plate 166. To provide adequate clearance between the terminating edge 188 of the first rotating plate 168 and the first tier aperture 174B, the length of the position line 216B is preferably on the order of 0.9 inches.

The inner edge 184 of the first rotating plate 168 is positioned at a distance sufficient to provide clearance between the first tier apertures 176A–176J and the inner edge 184 and also to provide clearance between the inner edge 184 and the outer edge 191 of the second rotating plate 170 (shown in FIGS, 8 and 11). Preferably, the inner edge 184 is on the order of 1.62 inches from the terminating edge 188 of the first rotating plate 168. This gives a clearance of about 0.12 inches between the first tier apertures 176A–176J and the inner edge 184. In the preferred embodiment of the first rotating plate 168, the apertures 176E and 176F are separated by an arc of about 50°, as measured along the terminating edge 188. The spacing between any two other adjacent first tier apertures 176A–176J is preferably equal to an arc of about 31°, as measured along the terminating edge 188. For example, the apertures 176D and 176E are separated by an arc of about 31° degrees, as are the apertures 176J and 176A. The passageway 193 is formed in the first rotating plate 168 between the aperture 176E and the aperture 176F and is preferably equidistant from both apertures 172E and 172F.

The characteristics of the second rotating plate 170 are best described with reference to FIGS. 10–12A. The second rotating plate 170 is sized to fit with the orifice 182 in the first rotating plate 168. To provide adequate clearance between the inner edge 184 of the first rotating plate 168 and the outer edge 191 of the second rotating plate 170, the outer edge 191 of the second rotating plate 170 is preferably on the order of 1.72 inches from the terminating edge 188 of the first rotating plate 168. This gives a clearance of about 0.1 inches between the inner edge 184 of the first rotating plate 168 and the outer edge 191 of the second rotating plate 170. As previously noted, the second tier apertures 178A–178D are formed in the second rotating plate 170. The characteristics of the second tier apertures 178A–178D, which are preferably equivalent, will be discussed with reference to the aperture 178B. The aperture 178B has a pre-determined size which is the length of a size line 222B that spans the aperture 178B and is generally aligned with the rotator direction B. The length of the size line 222B, and hence the size of the aperture 178B, is chosen to accommodate the handle portions of golf clubs. Consequently, the length of the size line 222B, and hence the pre-determined size of the aperture 178B, preferably is at least 1.25 inches. The aperture 178B is also positioned at a pre-determined distance form the outer edge 191 of the second rotating plate 170. The magnitude of this pre-determined distance is equal to the length of a position line 224B which extends from the outer edge 191 of the second rotating plate 170 to a first reference line 226B that spans the aperture 178B and is substantially parallel with a second reference line 228B which intersects the outer edge 191 of the second rotating plate 170 without crossing the outer edge 191. To provide adequate clearance between the aperture 178B and the outer edge 191, the length of the position line 224B is preferably on the order of 0.8 inches.

Figure 12A:
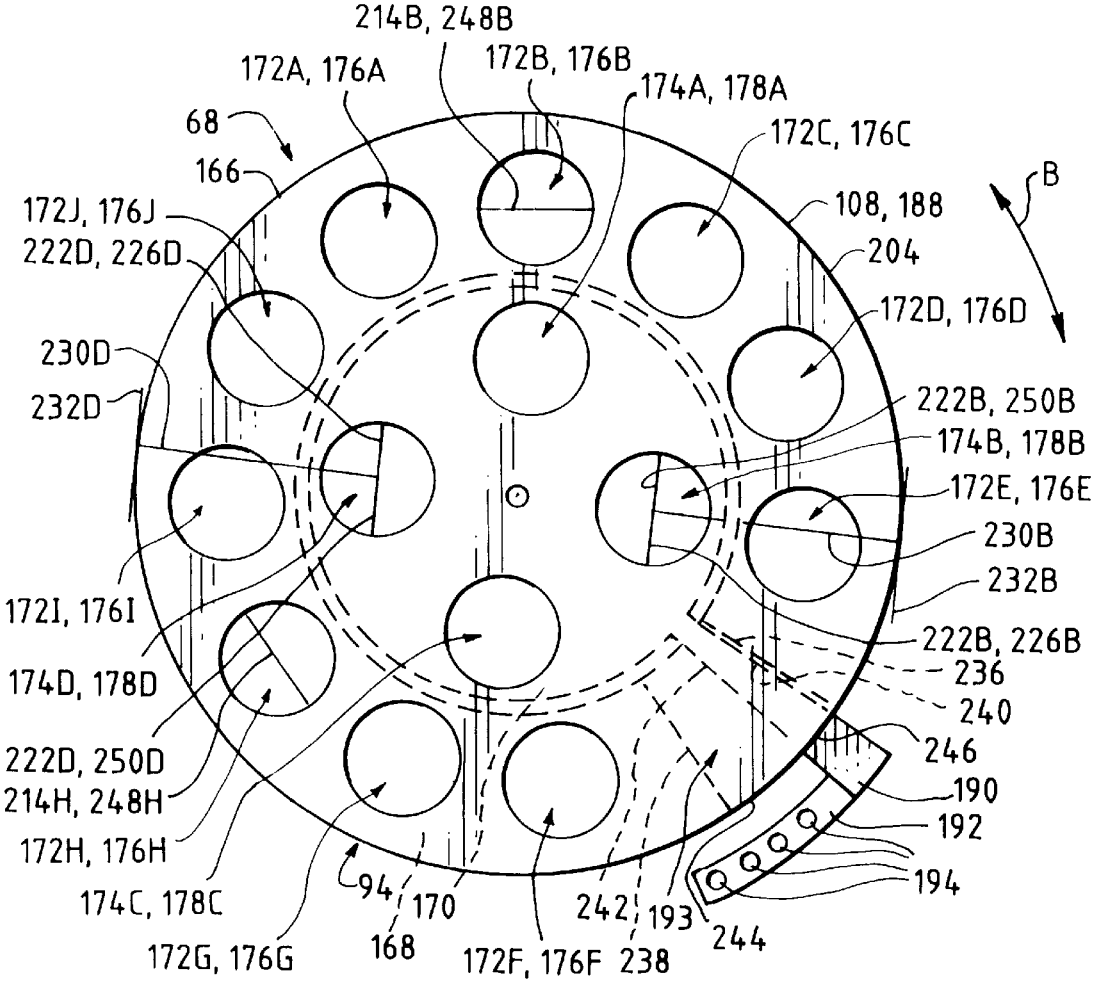
FIG. 12A is a top plan view of the divider plate shown in FIGS. 8 and 9, superimposed on the closing member shown in FIGS. 8, 10 and 11, and shows the closing member in an open configuration.

As previously noted, the second rotating plate 170 fits within the orifice 182 formed within the first rotating plate 168. The pre-determined distance of the aperture 178B from the outer edge 191 of the second rotating plate 170, together with the characteristics of the first rotating plate 168 and the second rotating plate 170, define a pre-determined position of the aperture 178B with reference to the first rotating plate 168. Specifically, as shown in FIG. 12A, the second tier aperture 178B is also at a pre-determined location which is at a second pre-determined distance from the terminating edge 188 of the first rotating plate 168 and hence from the outer edge 108 of the closing member 94. The magnitude of the second pre-determined distance from the terminating edge 188 of the first rotating plate 168 is equal to the length of a second position line 230B that extends between the first reference line 226B and a third reference line 232D which intersects the terminating edge 188 of the first rotating plate 168 without crossing the terminating edge 188. The second position line 230B is generally coincident with the position line 224B and is preferably about 2.5 inches in length.

Before describing the operation of the divider plate 166, the first rotating plate 168, and the second rotating plate 170, it is necessary to examine the characteristics of the arm 190 and the passageway 193 in more detail. As already noted, the first rotating plate 168 is moveable between the first position shown in FIG. 12A and the second position shown in FIG. 12C. When the first rotating plate 168 is so moved, the size of each of the first tier openings 172A–172J in the divider plate 166 changes from an open size (defined below with reference to FIG. 12A) to a closed size (defined below with reference to FIG. 12C). In the preferred embodiments of the divider plate 166 and the first rotating plate 168, the closed size of each of the first tier openings 172A–172J is on the order of 0.5 inches. Thus during operation, the first rotating plate 168 moves in the rotator direction B to an extent sufficient to decrease the size of each first tier opening 172A–172J to the closed size. If the previously described dimensions of the divider plate 166, including the first tier openings 172A–172J. and of the first rotating plate 168, including the first tier apertures 176A–176J, are used, each of the first tier apertures 176A–176J, such as the aperture 176B, moves through an arc of about 14° as measured along the outer edge 204 of the divider plate 166. Similarly, the second rotating plate 170 is moveable between the initial position shown in FIG. 12A to the final position shown in FIG. 12C. When the second rotating plate 170 is so moved, the size of each of the second tier openings 174A–174D in the divider plate 166 changes from a first effective size (defined below with reference to FIG. 12A) to a second effective size (defined below with reference to FIG. 12C). In the preferred embodiments of the divider plate 166 and the second rotating plate 170, the second effective size of each of the first tier openings 174A–174D is on the order of 0.5 inches. Thus, during operation the second rotating plate 170 moves in the rotator direction B to an extent sufficient to decrease the size of each of the second tier openings 174A–174D to the second effective size. If the previously described dimensions of the divider plate 166, including the second tier openings 174A–174D, and of the second rotating plate 170, including the second tier apertures 178A–178D, are used, each of the second tier apertures 178A–178D, such as the aperture 178B, moves through an arc of about 31° degrees as measured along the outer edge 204 of the divider plate 166. It can thus be seen that an arc of rotation, as measured along the outer edge 204 of the divider plate 166, needed to obtain the closed size of each of the first tier openings 172A–172J is less than an arc of rotation, as measured along the outer edge 204 of the divider plate 166, needed to obtain the second effective size of each of the second tier openings 174A–174D. To accommodate the difference between these arcs of rotation, the second rotating plate 170 initially rotates independently of the first rotating plate 168, due to the passageway 193.

Referring now to FIGS. 10–12A, two transverse edges 236 and 238 of the first rotating plate 168 define the passageway 193. As shown in FIG. 12A, when the first rotating plate 168 is in the first position and the second rotating plate 170 is in the initial position, a first edge 240 of the arm 190 is adjacent one of the transverse edges, for example, the transverse edge 236. A second edge 242 of the arm 190 is spaced apart from the other transverse edge 238. The width of the passageway 193 is chosen such that an arc 244 separating the second edge 242 of the arm 190 and the transverse edge 238, when the first rotating plate 168 is in the first position and the second rotating plate 170 is in the initial position, is about equal to one-half of the arc of rotation (as measured along the outer edge 204 of the divider plate 166) needed to obtain the second effective size of each of the second tier openings 174A–174D. In the preferred embodiments of the divider plate 166, of the first rotating plate 168, and of the second rotating plate 170, the size of the arc 244 is on the order of 15.5°. The width of the passageway 193 thus equals the size of the arc 244 plus the width of the arm 190. In the preferred embodiments of the divider plate 166 and the second rotating plate 170, the width of the arm 190 equals the dimension of an arc 246 defined by the arm 190 along the outer edge 204 of the divider plate 166. For example, if the arc 256 is about 5° the width of the arm 190 is about one-eighth inch as measured along the outer edge 204. Thus, the width of the passageway 193 equals the size of the arc 244 plus the size of the arc 246 which, in the preferred embodiments of the divider plate 166, the first rotating plate 168, and the second rotating plate 170, substantially equals about 20.5° or 0.46 inches as measured along the outer edge 204 of the divider plate 166.

The operation of the divider plate 166, the first rotating plate 168, and the second rotating plate 170 are now explained with reference to FIGS. 12A–12C. Throughout this discussion, the characteristics of the first tier openings 172A–172J will be examined with reference to one opening, the opening 172B, although it is to be understood that each of the first tier openings 172A–172J preferably has equivalent characteristics. Similarly, throughout this discussion the characteristics of the second tier openings 174A–174D will be examined with reference to one opening, the opening 174B, although it is to be understood that each of the second tier openings 174A–174D preferably has equivalent characteristics. FIG. 12A shows the divider plate 166 superimposed on the first rotating plate 168 and the second rotating plate 170 when the first rotating plate 168 is in the first position and the second rotating plate 170 is in the initial position. The first tier apertures 176A–176J in the first rotating plate 168 are aligned with the first tier openings 172A–172J in the divider plate 166 so that each of the first tier openings 172A–172J has an open size. The open size of the first tier opening 172B equals as the length of an open size line 248B that spans the opening 172B and is generally aligned with the rotator direction B when the first rotating plate 168 is in the first position. In the preferred embodiments of the divider plate 166 and the first rotating plate 168, the open size line 248B is generally coincident with the size line 196B when the first rotating plate 168 is in the first position. The second tier apertures 178A–178D in the second rotating plate 170 are aligned with the second tier openings 174A–174D in the divider plate 166 so that each of the second tier openings 174A–174D has a first effective size. The first effective size of the second tier opening 174B equals the length of a first effective size line 250B that spans the opening 174B and is generally aligned with the rotator direction B when the second rotating plate 170 is in the initial position. In the preferred embodiments of the divider plate 166 and the second rotating plate 170, the first effective size line 250B is generally coincident with the size line 222B when the second rotating plate 170 is in the initial position. The length of the open size line 248B and that of the first effective size line 250B should accommodate the handle portions of conventional golf clubs and so are preferably at least 1.25 inches. Consequently, when the closing member 94 is in the open configuration shown in FIG. 12A, golf clubs can be placed within or removed from the golf bag 50 (shown in FIG. 1) in the conventional manner.

Figure 12B:
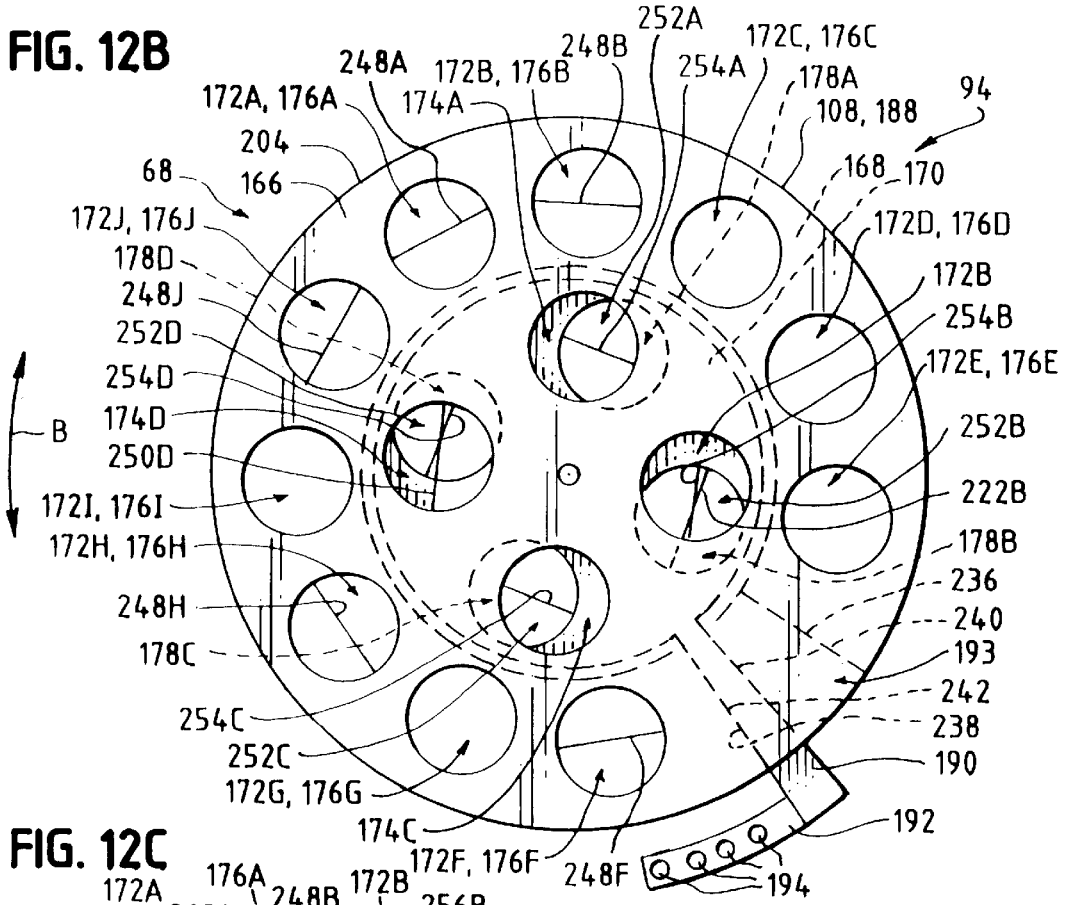
FIG. 12B is a top plan view of the divider plate shown in FIGS. 8 and 9, superimposed on the closing member shown in FIGS. 8, 10 and 11 and shows the closing member in an intermediate configuration.

In FIG. 12B the second rotating plate 170 has been moved in the rotator direction B to an intermediate position in which the edge 242 of the arm 190 is now adjacent the transverse edge 238 of the passageway 193 and both of the transverse edges 236 and 238 are in substantially the same position shown in FIG. 12A. In this intermediate position, each of the second tier apertures 178A–178D in the second rotating plate 170 is aligned with a corresponding one of the second tier openings 174A–174D in the divider plate 166 so that only portions 252A–252D of the second tier apertures 178A–178D are exposed. For example, the second tier aperture 178B in the second rotating plate 170 is aligned with the second tier opening 174B in the divider plate 166 so that the portion 252B of the second tier aperture 178B is exposed. The second tier opening 174B has an intermediate size which equals the length of an intermediate size line 254B that spans the exposed portion 252B of the second tier aperture 178B and is generally aligned with the rotator direction B when the second rotating plate 170 is in the intermediate position. It should be noted that the intermediate size of the second tier opening 174B is less than the first effective size of the second tier opening 174B. In contrast, the first rotating plate 168 has not moved from the first position because the passageway 193 permits the second rotating plate 170 to initially rotate independently of the first rotating plate 168. Consequently, the size of the first tier openings 172A–172J equals the length of the open size lines 248A–248J.

Figure 12C:
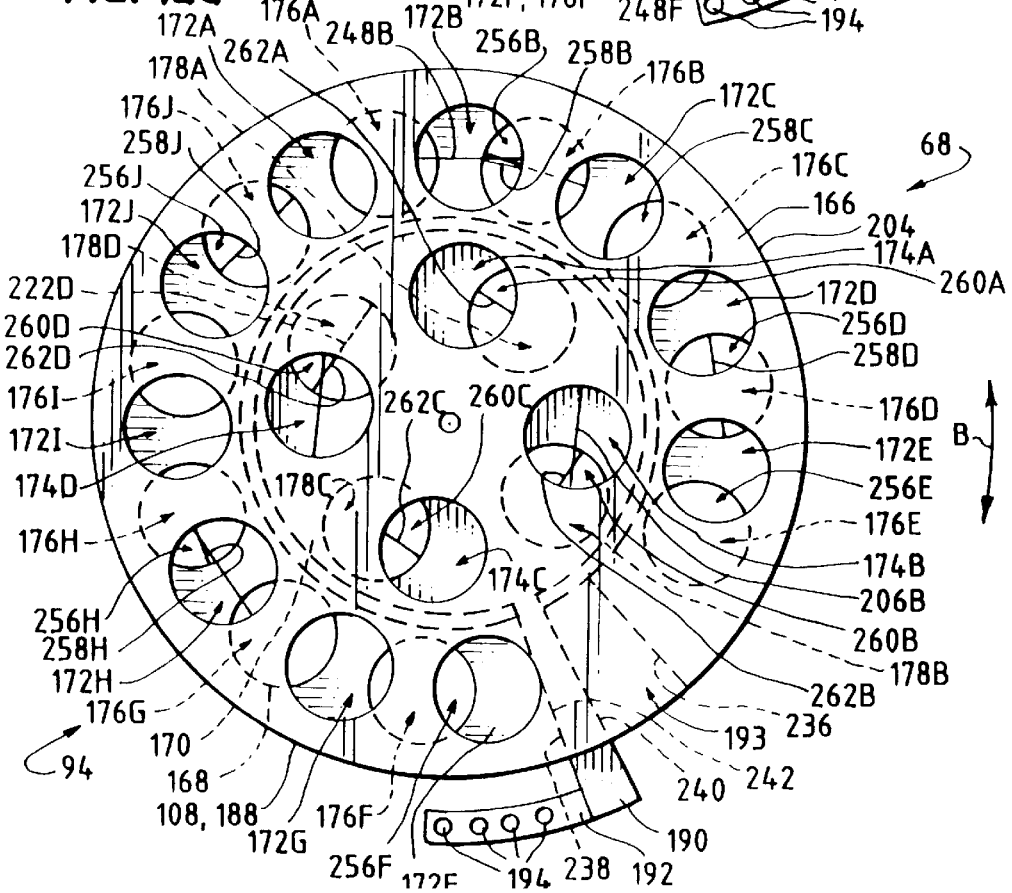
FIG. 12C is a top plan view of the divider plate shown in FIGS. 8 and 9, superimposed on the closing member shown in FIGS. 8, 10 and 11 and shows the closing member in a closed configuration.

In FIG. 12C the second rotating plate 170 has been moved further in the rotator direction B to the final position. Because the edge 242 of the arm 190 is adjacent the transverse edge 238 of the first rotating plate 168, the first rotating plate 168 has also moved in the rotator direction B and is now in the second position. FIG. 12C thus illustrates the closed configuration of the closing member 94 in which the first rotating plate 168 is in the second position and the second rotating plate 170 is in the final position. Since the first rotating plate 168 has moved from the first position to the second position, only portions 256A–256J of the first tier apertures 176A–176J are exposed and, consequently, each of the first tier openings 172A–172J has a closed size. For example, the closed size of the first tier opening 172B equals the length of a closed size line 258B that spans the exposed portion 256B of the second tier aperture 176B and is generally aligned with the rotator direction B when the first rotating plate 168 is in the second position. Similarly, because the second rotating plate 168 is in the final position, only portions 260A–260D of the second tier apertures 178A–178D are exposed and, consequently, each of the second tier openings 174A–174D has a second effective size. For example, the second effective size of the second tier opening 174B equals the length of a second effective size line 262B than spans the exposed portion 260B of the second tier aperture 178B and is generally aligned with the rotator direction B when the second rotating plate 170 is in the final position.

As can be seen by comparing FIGS. 12A and 12C, the length of the closed size line 258B is less than the length of the open size line 248B. The closed size of the first tier opening 172B is thus less than the open size of the opening 172B. Similarly, the length of the second effective size line 262B of the second tier opening 174B is less than the length of the first effective size line 250B so that the second effective size of the opening 174B is less than the first effective size of the opening 174A. Both the closed size of the first tier opening 172B and the second effective size of the second tier opening 174B are such that handle portions of conventional golf clubs cannot fit through the exposed portions 256B and 260B of the openings 176B and 178B, respectively. Thus, when the closing member 94 is in the closed configuration shown in FIG. 12C, golf clubs cannot be removed from the bag 50 (shown in FIG. 1). Moreover, the closing member 94 can be locked in the closed configuration shown in FIG. 12C by first inserting the strap rod 82 (shown in FIG. 3) through an appropriate one of the lock holes 194 before inserting the rod 82 into the channel 80 of the lock 76 (shown in FIG. 2) and mixing the tumblers 81. It can thus be seen that the alternative embodiment of the closing member 94 operates in conjunction with alternative embodiment 166 of the divider plate 68 to help to prevent theft of golf clubs from the bag 50.

The alternative embodiment of the closing member 94 also operates in conjunction with the a support for embodiment 166 of the divider plate 68 to provide support for golf clubs that are positioned either in the first tier openings 172A–172J or in the second tier openings 174A–174D. In the preferred embodiments of the divider plate 166, the first rotating plate 168, and the second rotating plate 170, when the closing member 94 is in the closed configuration shown in FIG. 12C, both the closed size of the first tier openings 172A–172J and the second effective size of the second tier openings 174A–174D are such that a shaft of a golf club positioned in one of the second tier openings 172A–172J, such as the opening 172B, is supported to about the same extent as a shaft of a golf club which is positioned in one of the first tier openings 174A–174D, such as the opening 174B. Preferably, the closed sizes of the first tier openings 172A–172J, such as the opening 172B, are within a range of about 35 to about 45 percent of the open sizes of the openings 172A–172J and the second effective sizes of the second tier openings 174A–174D, such as the opening 174B, are within a range of about 35 to about 45 percent of the first effective sizes. In particular, the length of the closed size line 258B is preferably about 0.5 inches, as is the length of the second effective size line 262B. Thus, when the length of the open size line 248B is on the order of 1.25 inches, the closed size of the first tier opening 172B is about 40 percent of the open size of the opening 172B. Similarly, when the length of the first effective size line 250B is on the order of 1.25 inches, the second effective size of the second tier opening 174B is about 40 percent of the first effective size. It can thus be seen that when the alternative embodiment of the closing member 94 is in the closed configuration shown in FIG. 12C, the alternative embodiment of the closing member 94 operates in conjunction with the alternative embodiment 166 of the divider plate 68 so that golf clubs which are positioned in the second tier openings 174A–174D are supported to an equivalent extent as are clubs that are positioned in the first tier openings 172A–172J.

The locking golf bag 50 of the present invention thus helps to protect a golfer's investment in his golf clubs. As explained with reference to FIGS. 7A–7B and 12A–12C, when the closing member 94 is in the closed configuration, golf clubs cannot be readily removed from within the bag 50. Moreover, the lock 76 can be used to lock the closing member 94 in the closed configuration. The locking golf bag 50 thus helps to protect against theft of golf clubs from within the bag 50. The lock 76 can also be used with the strap 70 to lock the bag 50 itself to an immoveable object. The locking golf bag 50 therefore also helps to protect against theft of the bag 50 itself. In addition, the locking golf bag 50 also helps to protect against excessive wear of golf clubs that are transported within the bag 50. As explained with reference to FIGS. 7A–7B and FIGS. 12A–12C, when the closing member 68 is in the closed configuration, a golf club is supported by the divider plate 68 and the closing member 94 regardless of which of the various openings 96A–96J, 98A–98D, 172A–172J or 174A–174D the club is positioned within. This support helps to prevent the club from rubbing against adjacent clubs or against the inner surface 56 of the body portion 52. The support provided by the closing member 94 and the divider plate 68 when the closing member 94 is in the closed configuration can be further enhanced by lining the various openings 96A–96J, 98A–98D, 172A–172J or 174A–174D and the various apertures 102A–102J, 104A–104D, 176A–176J, or 178A–178D with a soft, resilient, deformable material.

It should be noted that there are other possible embodiments for the closing member 94 which would satisfy all of the objectives of this invention. Therefore, although the present invention has been described with reference to specific embodiments thereof, it will be understood that various changes and modifications will be suggested to one skilled in the art and it is intended that the invention encompass such changes and modifications as fall within the scope of the appended claims.

What is claimed is:

1. A locking golf bag, comprising:

a body portion including a tubular wall having an inner surface, an outer surface and an upper edge, and a closed bottom secured to said tubular wall opposite said upper edge;

a divider plate secured to said tubular wall along said inner surface thereof and having a first opening and a second opening, said first opening having a pre-determined size and being positioned at a first pre-determined distance from said inner surface of said tubular wall, said second opening having a pre-determined size and being positioned at a second pre-determined distance from said inner surface of said tubular wall, said second pre-determined distance being greater than said first pre-determined distance;

a closing member coupled to said divider plate, moveable between an open configuration and a closed configuration, and having an outer edge, a first aperture, and a second aperture, said first aperture having a pre-determined size and being located at a pre-determined position, said pre-determined position of said first aperture being at a first pre-determined distance from said outer edge, said second aperture having a pre-determined size and being positioned at a pre-determined location, said pre-determined location of said second aperture being at a second pre-determined distance from said outer edge;

locking means for locking said closing member in said closed configuration;

an elongated strap having a first end and a second end, said second end being fixedly secured to said tubular wall proximate said closed bottom, said locking means reversibly connecting said first end to said tubular wall;

wherein in said open configuration, said first aperture is aligned with said first opening such that said first opening has an open size and said second aperture is aligned with said second opening such that said second opening has a first effective size; and wherein in said closed configuration, said first aperture is aligned with said first opening such that said first opening has a closed size and said second aperture is aligned with said second opening such that said second opening has a second effective size, said closed size being within a range of from about 35 percent of said open size to about 45 percent of said open size, and said second effective size being within a range of from about 35 percent of said first effective size to about 45 percent of said first effective size.

2. The locking golf bag of claim 1 wherein said pre-determined size of said second aperture substantially equals said pre-determined size of said first aperture.

3. The locking golf bag of claim 1 wherein said pre-determined size of said second opening substantially equals said pre-determined size of said first opening.

4. The locking golf bag of claim 3 wherein said pre-determined size of said second aperture substantially equals said pre-determined size of said first aperture.

5. The locking golf bag of claim 4 wherein at least one of said first and second openings is substantially circular.

6. The locking golf bag of claim 4 wherein at least one of said first and second apertures is substantially circular.

7. The locking golf bag of claim 4 wherein each of said first and second openings is substantially circular.

8. The locking golf bag of claim 7 wherein at least one of said first and second apertures is substantially circular.

9. The locking golf bag of claim 1 wherein said closing member is slidingly coupled to said divider plate.

10. The locking golf bag of claim 9 wherein said closing member includes a slider plate having a terminating edge and being slidingly moveable in a pre-determined slider direction from a first position to a second position, said terminating edge defining said outer edge of said closing member, said first aperture being formed in said slider plate at said pre-determined position of said first aperture, and said second aperture being formed in said slider plate at said pre-determined location of said second aperture, wherein said closing member is in said open configuration when said sliding plate is in said first position and said closing member is in said closed configuration when said slider plate is in said second position.

11. The locking golf bag of claim 10 wherein at least one of said first and second openings is substantially circular.

12. The locking golf bag of claim 10 wherein each of said first and second openings is substantially circular.

13. The locking golf bag of claim 10 further including a slider bar extending from said slider plate, wherein said locking means is reversibly coupled to said slider bar.

14. The locking golf bag of claim 13 wherein said slider bar is in substantial alignment with said pre-determined slider direction.

15. The locking golf bag of claim 1 wherein said closing member is rotatably coupled to said divider plate.

16. The locking golf bag of claim 15 wherein said closing member includes a first rotating plate, a second rotating plate, and coupling means for coupling said first rotating plate to said second rotating plate;

said first rotating plate being rotatably moveable between a first position and a second position and having a terminating edge and an inner edge, said terminating edge defining said outer edge of said closing member, said inner edge defining a centrally located orifice, said first aperture being formed in said first rotating plate intermediate said terminating edge and said orifice and being positioned at said pre-determined position of said first aperture;

said second rotating plate being positioned within said orifice and being rotatably moveable between an initial position and a final position, said second aperture being formed in said second rotating plate at said pre-determined location of said second aperture;

wherein said closing member is in said open configuration when said second rotating plate is in said initial position and said first rotating plate is in said first position; and wherein said closing member is in said closed configuration when said second rotating plate is in said final position and said first rotating plate is in said second position.

17. The locking golf bag of claim 16 wherein said first rotating plate further includes a passageway extending from said orifice to said terminating edge and having a pre-determined width and wherein said coupling means includes an outwardly extending arm affixed to said second rotating plate, positioned within said passageway, and having a pre-determined width less than said pre-determined width of said passageway.

18. The locking golf bag of claim 17 wherein at least one of said first and second openings is substantially circular.

19. The locking golf bag of claim 17 wherein each of said first and second openings is substantially circular.

20. The locking golf bag of claim 1 wherein said closed size is about 40 percent of said open size and said second effective size is about 40 percent of said first effective size.

21. The locking golf bag of claim 1 wherein said second effective size is about 0.5 inches long.

22. A locking golf bag, comprising:

a body portion including a tubular wall having an inner surface, an outer surface and an upper edge, and a closed bottom secured to said tubular wall opposite said upper edge;

a divider plate firmly secured to said tubular wall along said inner surface thereof and having a first opening and a second opening, said first opening having a pre-determined size and being positioned at a first pre-determined distance from said tubular wall, said second opening having a pre-determined size and being positioned at a second pre-determined distance from said tubular wall, said second pre-determined distance being greater than said first pre-determined distance;

a closing member slidingly coupled to said divider plate, moveable between an open configuration and a closed configuration, and having an outer edge, a first aperture, a second aperture, and a slider plate, said first aperture having a pre-determined size and being located at a pre-determined position, said pre-determined position of said first aperture being at a first pre-determined distance from said outer edge, said second aperture having a pre-determined size and being positioned at a pre-determined location, said pre-determined location of said second aperture being at a second pre-determined distance from said outer edge, said slider plate having a terminating edge and being slidingly moveable in a pre-determined slider direction from a first position to a second position, said terminating edge defining said outer edge of said closing member, said first aperture being formed in said slider plate at said pre-determined position of said first aperture, and said second aperture being formed in said slider plate at said pre-determined location of said second aperture, wherein said closing member is in said open configuration when said sliding plate is in said first position and said closing member is in said closed configuration when said slider plate is in said second position;

locking means for locking said closing member in said closed configuration;

a slider bar extending from said slider plate and in substantial alignment with said pre-determined slider direction, wherein said locking means is reversibly coupled to said slider bar;

wherein in said open configuration, said first aperture is aligned with said first opening such that said first opening has an open size and said second aperture is aligned with said second opening such that said second opening has a first effective size; and wherein in said closed configuration, said first aperture is aligned with said first opening such that said first opening has a closed size and said second aperture is aligned with said second opening such that said second opening has a second effective size, said closed size being within a range of from about 35 percent of said open size to about 45 percent of said open size, said second effective size being within a range of from about 35 percent of said first effective size to about 45 percent of said first effective size.

23. The locking golf bag of claim 22 wherein said closed size is about 40 percent of said open size.

24. The locking golf bag of claim 22 wherein said closed size is about 0.5 inches long.

25. A locking golf bag, comprising:

a body portion including a tubular wall having an inner surface, an outer surface and an upper edge, and a closed bottom secured to said tubular wall opposite said upper edge;

a divider plate secured to said tubular wall along said inner surface thereof and having a first opening and a second opening, said first opening having a pre-determined size and being positioned at a first pre-determined distance from said tubular wall, said second opening having a pre-determined size and being positioned at a second pre-determined distance from said tubular wall, said second pre-determined distance being greater than said first pre-determined distance;

a closing member rotatably coupled to said divider plate, moveable between an open configuration and a closed configuration, and having an outer edge, a first aperture, a second aperture, a first rotating plate, a second rotating plate, and coupling means for coupling said first rotating plate to said second rotating plate, said first aperture having a pre-determined size and being located at a pre-determined position, said pre-determined position of said first aperture being at a first pre-determined distance from said outer edge, said second aperture having a pre-determined size and being positioned at a pre-determined location, said pre-determined location of said second aperture being at a second pre-determined distance from said outer edge, said first rotating plate being rotatably moveable between a first position and a second position and having a terminating edge, an inner edge, and a passageway, said terminating edge defining said outer edge of said closing member, said inner edge defining a centrally located orifice, said passageway extending from said orifice to said terminating edge and having a pre-determined width, said first aperture being formed in said first rotating plate intermediate said terminating edge and said orifice and being positioned at said pre-determined position of said first aperture, said second rotating plate being positioned within said orifice and being rotatably moveable between an initial position and a final position, said second aperture being formed in said second rotating plate at said pre-determined location of said second aperture, said coupling means including an outwardly extending arm affixed to said second rotating plate, positioned within said passageway, and having a pre-determined width less than said pre-determined width of said passageway, wherein said closing member is in said open configuration when said second rotating plate is in said initial position and said first rotating plate is in said first position, and wherein said closing member is in said closed configuration when said second rotating plate is in said final position and said first rotating plate is in said second position;

wherein in said open configuration, said first aperture is aligned with said first opening such that said first opening has an open size, and said second aperture is aligned with said second opening such that said second opening has a first effective size; and wherein in said closed configuration, said first aperture is aligned with said first opening such that said first opening has a closed size and said second aperture is aligned with said second opening such that said second opening has a second effective size, said closed size being within a range of from about 35 percent of said open size to about 45 percent of said open size, and said second effective size being within a range of from about 35 percent of said first effective size to about 45 percent of said first effective size.

26. The locking golf bag of claim 25 wherein said open size is about 1.25 inches.

27. The locking golf bag of claim 25 wherein said closed size is about 0.5 inches.

* * * * *